US008876608B2

(12) United States Patent
Shepherd et al.

(10) Patent No.: US 8,876,608 B2
(45) Date of Patent: Nov. 4, 2014

(54) VIRTUALLY TRACKING UN-CARDED OR ANONYMOUS PATRON SESSION DATA

(75) Inventors: Jeffery Shepherd, Reno, NV (US); Richard E. Rowe, Las Vegas, NV (US); Larry C. Lewis, Las Vegas, NV (US); Brian Ford, Henderson, NV (US); Daryn Kiely, Henderson, NV (US)

(73) Assignee: IGT, Las Vegas, NV (US)

( * ) Notice: Subject to any disclaimer, the term of this patent is extended or adjusted under 35 U.S.C. 154(b) by 1337 days.

(21) Appl. No.: 12/100,387

(22) Filed: Apr. 9, 2008

(65) Prior Publication Data

US 2008/0188308 A1 Aug. 7, 2008

Related U.S. Application Data

(63) Continuation-in-part of application No. 10/886,944, filed on Jul. 7, 2004, now Pat. No. 7,927,211, which is a continuation-in-part of application No. 10/115,164, filed on Apr. 2, 2002, now Pat. No. 6,800,029, which is a continuation-in-part of application No. 09/544,884, filed on Apr. 7, 2000, now Pat. No. 6,682,421.

(51) Int. Cl.
*A63F 9/24* (2006.01)
*G07F 17/32* (2006.01)

(52) U.S. Cl.
CPC ..... *G07F 17/3237* (2013.01); *G07F 17/3241* (2013.01); *G07F 17/3239* (2013.01); *G07F 17/3244* (2013.01); *G07F 17/32* (2013.01)
USPC ..... 463/42; 463/25

(58) Field of Classification Search
CPC ..... G07F 17/3239; G07F 17/3241; A63F 2300/403; A63F 2300/406; A63F 2300/5546; A63F 2300/5573
USPC ..... 463/25, 39, 43, 16, 29, 40–42
See application file for complete search history.

(56) References Cited

U.S. PATENT DOCUMENTS 4,575,621 A 3/1986 Dreifus
4,764,666 A 8/1988 Bergeron (Continued)

FOREIGN PATENT DOCUMENTS

AU 199954012 4/2000
AU 2001249901 10/2001

(Continued)

OTHER PUBLICATIONS

Bronstein et al., "Three-Dimensional Face Recognition," International Journal of Computer Vision, vol. 64/1, Aug. 2005 (44 pages).

(Continued)

*Primary Examiner* — Damon Pierce
(74) *Attorney, Agent, or Firm* — Foley & Lardner LLP

(57) ABSTRACT

A system for tracking a player session is provided, having a portable transaction device with an input device for receiving input for player characterization information for the player and a first network interface. A gaming server may have a second network interface configured for communication with the portable transaction device, a logic system, and a storage system. The storage system may be used for storing at least the following according to commands from the logic system: a player identification database including player characterization information received from the portable transaction device via the second network interface, a unique identifier database having a unique identifier assigned to the player, the unique identifier paired with the player characterization information for the player, and a wagering location database having at least one wagering location, the at least one wagering location paired with the unique identifier to track the player session.

14 Claims, 11 Drawing Sheets

(56) References Cited

U.S. PATENT DOCUMENTS

| | | | |
|---|---|---|---|
| 4,768,151 | A | 8/1988 | Birenbaum et al. |
| 5,061,845 | A | 10/1991 | Pinnavaia |
| 5,129,652 | A | 7/1992 | Wilkinson |
| 5,179,517 | A | 1/1993 | Sarbin et al. |
| 5,218,356 | A | 6/1993 | Knapp |
| 5,244,207 | A | 9/1993 | Laatikainen |
| 5,265,874 | A | 11/1993 | Dickinson et al. |
| 5,326,104 | A | 7/1994 | Pease et al. |
| 5,382,784 | A | 1/1995 | Eberhardt |
| 5,457,306 | A | 10/1995 | Lucero |
| 5,505,461 | A | 4/1996 | Bell et al. |
| 5,528,248 | A | 6/1996 | Steiner et al. |
| 5,557,086 | A | 9/1996 | Schulze et al. |
| 5,586,936 | A | 12/1996 | Bennett et al. |
| 5,613,911 | A | 3/1997 | Takemoto et al. |
| 5,618,045 | A | 4/1997 | Kagan et al. |
| 5,643,086 | A | 7/1997 | Alcorn et al. |
| 5,678,886 | A | 10/1997 | Inganti |
| 5,738,583 | A | 4/1998 | Comas et al. |
| 5,741,183 | A | 4/1998 | Acres et al. |
| 5,752,882 | A | 5/1998 | Acres et al. |
| 5,759,102 | A | 6/1998 | Pease et al. |
| 5,761,647 | A | 6/1998 | Boushy et al. |
| 5,768,382 | A | 6/1998 | Schneier et al. |
| 5,770,533 | A | 6/1998 | Franchi |
| 5,779,545 | A | 7/1998 | Berg et al. |
| 5,779,546 | A | 7/1998 | Meissner et al. |
| 5,779,549 | A | 7/1998 | Walker et al. |
| 5,795,228 | A | 8/1998 | Trumbull et al. |
| 5,797,085 | A | 8/1998 | Beuk et al. |
| 5,816,917 | A | 10/1998 | Kelmer et al. |
| 5,820,459 | A | 10/1998 | Acres et al. |
| 5,871,398 | A | 2/1999 | Schneier et al. |
| 5,915,023 | A | 6/1999 | Bernstein |
| 5,967,896 | A | 10/1999 | Jorasch et al. |
| 5,971,855 | A | 10/1999 | Ng |
| 5,999,808 | A | 12/1999 | LaDue |
| 6,001,016 | A | 12/1999 | Walker et al. |
| 6,003,013 | A | 12/1999 | Boushy et al. |
| 6,012,832 | A | 1/2000 | Saunders et al. |
| 6,012,983 | A | 1/2000 | Walker et al. |
| 6,019,283 | A | 2/2000 | Lucero |
| 6,048,269 | A | 4/2000 | Burns et al. |
| 6,068,552 | A | 5/2000 | Walker et al. |
| 6,093,100 | A | 7/2000 | Singer et al. |
| 6,104,815 | A | 8/2000 | Alcorn et al. |
| 6,106,396 | A | 8/2000 | Alcorn et al. |
| 6,110,041 | A | 8/2000 | Walker et al. |
| 6,117,013 | A | 9/2000 | Eiba |
| 6,142,876 | A | 11/2000 | Cumbers |
| 6,149,522 | A | 11/2000 | Alcorn et al. |
| 6,165,071 | A | 12/2000 | Weiss |
| 6,210,279 | B1 | 4/2001 | Dickinson |
| 6,253,119 | B1 | 6/2001 | Dabrowski |
| 6,254,006 | B1 | 7/2001 | Mish |
| 6,270,410 | B1 | 8/2001 | DeMar et al. |
| 6,280,326 | B1 | 8/2001 | Saunders |
| 6,284,406 | B1 | 9/2001 | Xing et al. |
| 6,285,868 | B1 | 9/2001 | LaDue |
| 6,287,200 | B1 | 9/2001 | Sharma |
| 6,312,333 | B1 | 11/2001 | Acres |
| 6,331,144 | B1 | 12/2001 | Walker et al. |
| 6,340,331 | B1 | 1/2002 | Saunders et al. |
| 6,343,988 | B1 | 2/2002 | Walker et al. |
| 6,347,996 | B1 | 2/2002 | Gilmore et al. |
| 6,379,248 | B1 | 4/2002 | Jorasch et al. |
| 6,383,077 | B1 | 5/2002 | Kweitko et al. |
| 6,431,983 | B2 | 8/2002 | Acres |
| 6,439,996 | B2 | 8/2002 | LeMay et al. |
| 6,488,585 | B1 | 12/2002 | Wells et al. |
| 6,508,709 | B1 | 1/2003 | Karmarkar |
| 6,511,377 | B1 | 1/2003 | Weiss |
| 6,514,140 | B1 | 2/2003 | Storch |
| 6,533,662 | B2 | 3/2003 | Soltys et al. |
| 6,554,707 | B1 | 4/2003 | Sinclair et al. |
| 6,564,995 | B1 | 5/2003 | Montgomery |
| 6,564,997 | B1 | 5/2003 | Juds |
| 6,579,185 | B1 | 6/2003 | Honda et al. |
| 6,582,311 | B1 | 6/2003 | Sugimura |
| 6,612,928 | B1 | 9/2003 | Bradford et al. |
| 6,676,522 | B2 | 1/2004 | Rowe et al. |
| 6,679,775 | B1 | 1/2004 | Luciano et al. |
| 6,681,984 | B2 | 1/2004 | Brunner |
| 6,682,421 | B1 | 1/2004 | Rowe et al. |
| 6,687,700 | B1 | 2/2004 | Cornelius et al. |
| 6,702,672 | B1 | 3/2004 | Angell et al. |
| 6,712,698 | B2 | 3/2004 | Paulsen et al. |
| 6,716,103 | B1 | 4/2004 | Eck et al. |
| 6,722,985 | B2 | 4/2004 | Criss-Puszkiewicz et al. |
| 6,729,957 | B2 | 5/2004 | Burns et al. |
| 6,732,195 | B1 | 5/2004 | Baldwin |
| 6,758,393 | B1 | 7/2004 | Luciano et al. |
| 6,761,637 | B2 | 7/2004 | Weston et al. |
| 6,800,029 | B2 | 10/2004 | Rowe et al. |
| 6,805,634 | B1 | 10/2004 | Wells et al. |
| 6,846,238 | B2 | 1/2005 | Wells |
| 6,852,031 | B1 | 2/2005 | Rowe |
| 6,935,958 | B2 | 8/2005 | Nelson |
| 6,971,956 | B2 | 12/2005 | Rowe et al. |
| 6,984,175 | B2 | 1/2006 | Nguyen et al. |
| 6,987,948 | B2 | 1/2006 | Engstrom et al. |
| 7,260,834 | B1 | 8/2007 | Carlson |
| 7,350,696 | B2 | 4/2008 | Frerking |
| 7,883,417 | B2 | 2/2011 | Bruzzese et al. |
| 7,927,211 | B2 | 4/2011 | Rowe et al. |
| 2001/0006195 | A1 | 7/2001 | Sukeda et al. |
| 2001/0044337 | A1 | 11/2001 | Rowe et al. |
| 2002/0047044 | A1 | 4/2002 | Orus et al. |
| 2002/0111815 | A1 | 8/2002 | Smith |
| 2002/0132663 | A1* | 9/2002 | Cumbers ..... 463/25 |
| 2002/0142846 | A1 | 10/2002 | Paulsen |
| 2002/0152120 | A1 | 10/2002 | Howington |
| 2003/0031321 | A1 | 2/2003 | Mages |
| 2003/0045353 | A1 | 3/2003 | Paulsen et al. |
| 2003/0045354 | A1 | 3/2003 | Giobbi |
| 2003/0054878 | A1* | 3/2003 | Benoy et al. ..... 463/29 |
| 2003/0083126 | A1 | 5/2003 | Paulsen et al. |
| 2003/0087652 | A1 | 5/2003 | Simon et al. |
| 2003/0148812 | A1 | 8/2003 | Paulsen et al. |
| 2003/0228907 | A1 | 12/2003 | Gatto et al. |
| 2004/0002386 | A1 | 1/2004 | Wolfe et al. |
| 2004/0048667 | A1 | 3/2004 | Rowe |
| 2004/0204244 | A1 | 10/2004 | Rathsack et al. |
| 2004/0209690 | A1 | 10/2004 | Bruzzese et al. |
| 2005/0009600 | A1 | 1/2005 | Rowe et al. |
| 2005/0054438 | A1 | 3/2005 | Rothschild et al. |
| 2005/0124407 | A1 | 6/2005 | Rowe |
| 2005/0124411 | A1 | 6/2005 | Schneider et al. |
| 2006/0068904 | A1 | 3/2006 | Nguyen et al. |
| 2007/0004510 | A1 | 1/2007 | Underdahl et al. |
| 2007/0060311 | A1 | 3/2007 | Rowe et al. |
| 2007/0060394 | A1 | 3/2007 | Gowin et al. |
| 2007/0087834 | A1 | 4/2007 | Moser et al. |
| 2007/0099696 | A1 | 5/2007 | Nguyen et al. |
| 2007/0117623 | A1 | 5/2007 | Nelson et al. |
| 2008/0188308 | A1 | 8/2008 | Shepherd et al. |

FOREIGN PATENT DOCUMENTS

| | | | |
|---|---|---|---|
| AU | 2001255746 | | 11/2001 |
| CA | 2312121 | | 12/2000 |
| DE | 195 02 613 | | 1/1995 |
| EP | 0 360 613 | | 3/1990 |
| EP | 1 139 310 | A2 | 4/2001 |
| GB | 2 161 629 | A | 1/1986 |
| RU | 2 060 756 | | 5/1996 |
| RU | 2 072 560 | | 1/1997 |
| RU | 2 132 569 | C1 | 6/1999 |
| RU | 2 145 116 | C1 | 1/2000 |
| WO | WO 95/10824 | | 4/1995 |
| WO | WO-95/30944 | | 11/1995 |
| WO | WO 96/12262 | | 4/1996 |
| WO | WO 97/19537 | | 5/1997 |
| WO | WO 97/44750 | | 11/1997 |

(56) References Cited

FOREIGN PATENT DOCUMENTS

| | | |
|---|---|---|
| WO | WO 98/30297 | 7/1998 |
| WO | WO 99/10061 | 3/1999 |
| WO | WO 99/16030 | 4/1999 |
| WO | WO 99/22350 | 5/1999 |
| WO | WO 99/23594 | 5/1999 |
| WO | WO-99/42301 | 8/1999 |
| WO | WO 99/51313 | 10/1999 |
| WO | WO 00/79467 | 12/2000 |
| WO | WO 01/25992 | 4/2001 |
| WO | WO 01/54091 | 7/2001 |
| WO | WO 01/74461 | 10/2001 |
| WO | WO 01/91075 | 11/2001 |
| WO | WO 01/91866 | 12/2001 |
| WO | WO 02/21370 | 3/2002 |
| WO | WO 02/43019 | 5/2002 |
| WO | WO 2002/103550 A1 | 12/2002 |
| WO | WO 03/015299 | 2/2003 |
| WO | WO 2004/064354 | 7/2004 |
| WO | WO 2004/090818 | 10/2004 |
| WO | WO 2005/098766 | 10/2005 |
| WO | WO 2006/010011 | 1/2006 |
| WO | WO 2009/126736 | 10/2009 |

OTHER PUBLICATIONS

Yuan et al., "Virtual Private Networks—Technologies and Solutions," Addison-Wesley, ISBN#0-201-70209-6, 2001 (8 pages).
U.S. Office Action dated Nov. 29, 2001 issued in U.S. Appl. No. 09/544,884.
U.S. Office Action Final dated Jun. 5, 2002 issued in U.S. Appl. No. 09/544,884.
U.S. Office Action dated Nov. 12, 2002 issued in U.S. Appl. No. 09/544,884.
U.S. Office Action (Examiner Interview Summary) dated Feb. 4, 2003 issued in U.S. Appl. No. 09/544,884.
U.S. Office Action Final dated May 7, 2003 issued in U.S. Appl. No. 09/544,884.
U.S. Office Action (Examiner Interview Summary) dated Aug. 8, 2003 issued in U.S. Appl. No. 09/544,884.
U.S. Notice of Allowance and Allowability dated Sep. 10, 2003 issued in U.S. Appl. No. 09/544,884.
U.S. Office Action dated Jun. 1, 2004 issued in U.S. Appl. No. 10/044,218.
U.S. Office Action Final dated Jan. 25, 2005 issued in U.S. Appl. No. 10/044,218.
U.S. Office Action (Examiner Interview Summary) dated Apr. 8, 2005 issued in U.S. Appl. No. 10/044,218.
U.S. Notice of Allowance dated Jun. 15, 2005 issued in U.S. Appl. No. 10/044,218.
U.S. Supplemental Notice of Allowability dated Sep. 30, 2005 issued in U.S. Appl. No. 10/044,218.
U.S. Office Action dated Jul. 2, 2003 issued in U.S. Appl. No. 10/115,164.
U.S. Office Action Final dated Dec. 16, 2003 issued in U.S. Appl. No. 10/115,164.
U.S. Office Action (Advisory Action) dated Mar. 3, 2004 issued in U.S. Appl. No. 10/115,164.
U.S. Notice of Allowance dated Apr. 9, 2004 issued in U.S. Appl. No. 10/115,164.
U.S. Office Action dated Jun. 24, 2008 issued in U.S. Appl. No. 10/886,944.
U.S. Office Action dated Mar. 10, 2009 issued in U.S. Appl. No. 10/886,944.
U.S. Office Action Final dated Jul. 31, 2009 issued in U.S. Appl. No. 10/886,944.
U.S. Office Action dated Apr. 2, 2010 issued in U.S. Appl. No. 10/886,944.
U.S. Notice of Allowance dated Oct. 1, 2010 issued in U.S. Appl. No. 10/886,944.
U.S. Notice of Allowance dated Feb. 22, 2011 issued in U.S. Appl. No. 10/886,944.
U.S. Office Action dated Jul. 30, 2003 issued in U.S. Appl. No. 09/718,974.
U.S. Office Action Final dated Dec. 30, 2003 issued in U.S. Appl. No. 09/718,974.
U.S. Office Action (Examiner Interview Summary) dated Mar. 18, 2004 issued in U.S. Appl. No. 09/718,974.
U.S. Notice of Allowance dated Sep. 30, 2004 issued in U.S. Appl. No. 09/718,974.
U.S. Office Action dated Jun. 23, 2008 issued in U.S. Appl. No. 11/040,697.
U.S. Office Action Final dated Feb. 2, 2009 issued in U.S. Appl. No. 11/040,697.
U.S. Office Action dated Jul. 8, 2009 issued in U.S. Appl. No. 11/040,697.
U.S. Office Action Final dated Feb. 19, 2010 issued in U.S. Appl. No. 11/040,697.
U.S. Office Action dated Aug. 22, 2002 issued in U.S. Appl. No. 09/882,559.
U.S. Office Action Final dated Jan. 27, 2003 issued in U.S. Appl. No. 09/882,559.
U.S. Notice of Allowance dated Jul. 16, 2003 issued in U.S. Appl. No. 09/882,559.
U.S. Office Action dated Dec. 20, 2006 issued in U.S. Appl. No. 10/817,156.
U.S. Office Action (Examiner Interview Summary) dated Jun. 5, 2007 issued in U.S. Appl. No. 10/817,156.
U.S. Office Action dated Jun. 12, 2007 issued in U.S. Appl. No. 10/817,156.
US Office Action (Advisory Action) dated Aug. 24, 2007 issued in U.S. Appl. No. 10/817,156.
US Notice of Abandonment dated Jan. 29, 2008 issued in U.S. Appl. No. 10/817,156.
U.S. Notice of Rescinded Abandonment dated May 16, 2008 issued in U.S. Appl. No. 10/817,156.
U.S. Office Action dated Sep. 23, 2008 issued in U.S. Appl. No. 10/817,156.
U.S. Office Action dated Jun. 1, 2009 issued in U.S. Appl. No. 10/817,156.
U.S. Office Action Final dated Nov. 9, 2009 issued in U.S. Appl. No. 10/817,156.
U.S. Office Action Final dated Jan. 28, 2010 issued in U.S. Appl. No. 10/817,156.
U.S. Notice of Allowance dated Jun. 24, 2010 issued in U.S. Appl. No. 10/817,156.
U.S. Pre-appeal Brief Conference Decision dated Jul. 1, 2010 issued in U.S. Appl. No. 10/817,156.
U.S. Notice of Allowance dated Oct. 21, 2010 issued in U.S. Appl. No. 10/817,156.
U.S. Office Action dated Jun. 7, 2004 issued in U.S. Appl. No. 10/085,779.
U.S. Notice of Allowance and Fees Due dated Apr. 5, 2005 issued in U.S. Appl. No. 10/085,779.
U.S. Notice of Allowance and Fees Due dated Sep. 27, 2005 issued in U.S. Appl. No. 10/085,779.
PCT International Search Report dated Mar. 18, 2002 issued in PCT/US2001/11134 (WO 2001/76710).
PCT International Written Opinion dated May 3, 2002 issued in PCT/US2001/11134 (WO 2001/76710).
PCT International Preliminary Examination Report dated Jul. 2, 2002 issued in PCT/US2001/11134 (WO 2001/76710).
Australian Office Action dated May 25, 2005 issued in AU2001249901.
Australian Notice of Acceptance dated Feb. 26, 2007 issued in AU2001249901.
Canadian Examination Report dated Mar. 20, 2009 issued in 2,405,166.
Canadian Office Action dated Feb. 3, 2011 issued in 2,405,166.
European Examination Report dated Dec. 15, 2004 issued in EP01923183.6.
European Office Action (Rule 51(4) EPC) dated Oct. 24, 2005 issued in EP01923183.6.
European Search Report dated Jun. 12, 2006 issued in EP 06003771.0.

(56) References Cited

OTHER PUBLICATIONS

PCT International Search Report dated Jul. 23, 2003 issued in PCT/US2003/09027 (WO 2003/084625).
PCT International Preliminary Examination Report dated Jan. 27, 2004 issued in PCT/US2003/09027 (WO 2003/084625).
Australian Examiner's First Report dated Jul. 3, 2008 issued in AU2003225966.
UK Examination Report dated Apr. 7, 2005 issued in GB0422040.6.
PCT International Preliminary Report on Patentability and Written Opinion dated Apr. 19, 2006 issued in PCT/US2005/024298 (WO2006/010011).
AU First Examiner's Report dated Feb. 26, 2010 issued in AU 2005265273.
AU Second Examiner's Report dated Mar. 16, 2011 issued in AU 2005265273.
PCT International Search Report and Written Opinion dated Jul. 3, 2009 issued in PCT/US2009/039953.
PCT International Written Opinion dated May 6, 2003 issued in PCT/US2001/023724 (WO 2002/043019).
PCT International Preliminary Examination Report dated Jun. 25, 2003 issued in PCT/US2001/023724 (WO 2002/043019).
AU Examiner's First Report dated Feb. 15, 2006 issued in 2001 280 853.
CA Office Action dated Aug. 8, 2006 issued in CA Application No. 2,429,529.
CA Office Action dated Nov. 14, 2007 issued in CA Application No. 2,429,529.
PCT International Preliminary Examination Report dated Aug. 22, 2003 issued in PCT/US02/18875.
PCT International Search Report dated Sep. 12, 2002 issued in PCT/US02/18875.
PCT Written Opinion dated Feb. 24, 2003 issued in PCT/US02/18875.
AU Examiner's First Report dated Mar. 23, 2007 issued in AU 2002322096.
AU Examiner's Second Report dated Oct. 23, 2007 issued in AU 2002322096.
AU Notice of Opposition dated Apr. 6, 2009 issued in AU 2002322096.
AU Statement of Grounds and Particulars dated Jul. 3, 2009 issued in AU 2002322096.
AU Notice Opposition has been Withdrawn dated Aug. 19, 2009 issued in AU 2002322096.
European Supplementary Search Report dated Dec. 4, 2008 issued in EP 02 756 187.7-2221.
European Examination Report dated Mar. 2, 2009 issued in EP 02 756 187.7-2221.
RU Advisory Office Action dated May 31, 2006 issued in RU 2003136278/09.
RU Resolution on Granting dated Oct. 4, 2006 issued in RU 2003136278/09.
PCT International Search Report dated Jul. 25, 2005 issued in PCT/US2005/011217 (WO2005/098766).
PCT International Preliminary Report on Patentability and Written Opinion dated Oct. 4, 2006 issued in PCT/US2005/011217 (WO2005/098766).
AU Examiner's first report dated Dec. 18, 2009 issued in AU Application No. 2005232204.
UK Examination Report dated Mar. 28, 2007 issued in GB 0620783.1.
UK Examination Report dated Nov. 13, 2007 issued in GB 0620783.1.
EP Search Report dated Jul. 12, 2005 issued in 04252032.0 [Note: EP Appl. & P145 claim priority to AU Patent Appl. No. 2003 901 552 cited in P145].
Artobolevsky, I.I. Polytechnic dictionary, Moscow, Soviet Encyclopedia, 1976, p. 426.
LeMay et al., "Gaming Machine Virtual Player Tracking and Related Services", filed Aug. 18, 2000, U.S. Appl. No. 09/642,192.
Schneier B., (1996) "Applied Cryptography, Second Edition," *Applied Cryptography, Protocols, Algorithms, and Source Code in C*, pp. 31-38, 50-51 (8 pgs), XP002248999, ISBN: 0-471-11709-9.
Wang et al., (Jan. 1, 2000) "Casino Technology: Player Tracking and Slot Accounting Systems", *Gaming Research and Review Journal*, UNLV International Gaming Institute, Las Vegas, NV, US, pp. 43-56.
Yolanda Smulik Roche and Roger C. Roche, "The Tax Man Cometh", CasinoGaming.com Parts I and II, [http://www.casinogaming.com/features/taxlaws.html, downloaded on Dec. 8, 2008], 8 pages.
"The Tax Man Cometh," CasinoGaming.com, Parts I and II (undated).
Canadian Office Action for Application No. 2,779,504, dated Mar. 25, 2013, 3 pages.
Canadian Office Action dated Nov. 15, 2013 issued in Canadian Application No. 2,779,504, 3 pages.

* cited by examiner

VIRTUALLY TRACKING UN-CARDED OR ANONYMOUS PATRON SESSION DATA

CROSS-REFERENCE TO RELATED APPLICATIONS

This application is a continuation-in-part and claims priority under 35 U.S.C. §120 from co-pending U.S. patent application Ser. No. 10/886,944, filed Jul. 7, 2004, entitled "Gaming Environment Including Portable Transaction Devices," which is a continuation-in-part and claims priority under 35 U.S.C. §120 from U.S. patent application Ser. No. 10/115,164, filed Apr. 2, 2002, entitled "Gaming Environment Including Portable Transaction Devices," now issued as U.S. Pat. No. 6,800,029, which is a continuation-in-part and claims priority under 35 U.S.C. §120 from U.S. patent application Ser. No. 09/544,884, filed Apr. 7, 2000, entitled "Wireless Gaming Environment," now issued as U.S. Pat. No. 6,682,421, each of which is incorporated herein in their entirety and for all purposes.

TECHNICAL FIELD

The present invention relates to tracking patron session data, and more particularly to virtually tracking un-carded or anonymous patron session data using portable transaction devices.

BACKGROUND

In casino or other gaming environments, a variety of data regarding electronically controlled gaming devices is collected. This information is used in a variety of ways, including for the direct benefit of the player.

Commonly, information regarding a player's game play at an electronic gaming machine, such as a video poker or slot machine, is tracked. Based on the player's game play, such as amounts bet or amounts won or lost, the casino may reward the player with a complimentary award or "comp." For example, a player who plays one or more gaming devices for a particular length of time or places bets aggregating a certain total may be rewarded for their level of play with a comp. The comp may comprise free game play, free lodging or other free or reduced cost goods or services.

Gaming device information is also tracked to determine the level of game play at the device. A casino may determine from this game play information, for example, that players no longer like to play a particular game. The casino can then replace the device with a different device that presents a game which players like better. A casino may also determine that the level of play of a machine is low because the gaming device does not have a high enough level of payback, or is placed in an undesirable location within the casino.

Of course, the tracking of gaming device data is useful for accomplishing a wide variety of other internal casino functions. For example, using coin in and coin out data at a machine, the casino can reconcile collected coins from the device to ensure that theft is not occurring at the device.

These functions are easily implemented with respect to electronic gaming devices that are arranged to collect or generate the desired data and transmit it, such as via a wired network, to a central computer. However, game play sessions may be tracked if: 1) the patron is carded and part of the casino's players club, and 2) the patron remembers to insert the card into the gaming machine and/or give the card to the dealer or pit boss at a table game. Game play sessions for un-carded or forgetful patrons are not tracked.

Although a patron may be approached by a host within the casino and invited to join the players club or obtain a replacement player tracking card, there are a number of players who, for a variety of reasons, do not wish to join and prefer to remain anonymous.

SUMMARY OF THE INVENTION

The invention relates to tracking patron session data, and more particularly to virtually tracking un-carded or anonymous patron session data using portable transaction devices. In one embodiment, a method for tracking a wager gaming session may comprise receiving a first user input indicating first player characterization data for an observed player at a first wagering location, transmitting the first player characterization data to a central system, receiving, from the central system, at least one player identifier and matching player characterization data corresponding to the first player characterization data, displaying associated player characterization data for at least one player, and receiving a second user input indicating whether the matching player characterization data correspond to the observed player.

In one embodiment, a system for tracking a game play session may have a portable transaction device having a display device to display a plurality of user options, an input device configured to receive input by a user for at least one player characterization information and a first wagering location data, and a first logic system configured to communicate with the display and input device. The logic system may be configured to transmit the at least one player characterization information and the first wagering location data to a central system, receive at least one unique identifier from the central system, and display the unique identifier on the display device. A gaming server may be configured to communicate with the portable transaction device, the gaming server having a storage system having at least one memory for storing a plurality of player characterization information, each of the plurality of player characterization information associated with a unique identifier, and a second logic system configured to do the following search the storage system for the player characterization information and transmit at least one unique identifier to the portable transaction device according to the result of the search.

In another embodiment, a method for tracking a wager gaming session may comprise receiving, at a central system, first player characterization data and first wagering location data for a player who is not participating in a player loyalty session at a first wagering location, searching stored player characterization data to determine whether the first player characterization data match stored player characterization data, the stored player characterization data having associated player identifiers, and transmitting at least one of a player identifier and matching player characterization data to a portable transaction device according to the result of the searching step.

In yet another embodiment, a method for tracking a wager gaming session, may comprise identifying a player who is not participating in a player loyalty session at a first wagering location, transmitting first player characterization data for an identified player and first wagering location data to a central system, searching stored player characterization data to determine whether the first player characterization data match stored player characterization data, the stored player characterization data having associated player identifiers, and transmitting at least one of a player identifier and matching player characterization data to a portable transaction device according to the result of the searching step.

In still another embodiment, a method for tracking a wager gaming session may comprise receiving a first user input indicating first player characterization data for an observed player at a first wagering location, transmitting the first player characterization data to a central system, receiving, from the central system, at least one player identifier and matching player characterization data corresponding to the first player characterization data, displaying associated player characterization data for at least one player, and receiving a second user input indicating whether the matching player characterization data correspond to the observed player.

In another embodiment, a system for tracking a wager gaming session may have an interface system comprising at least one interface configured for communication with a portable device, a memory system comprising at least one memory having player characterization data and corresponding player identifiers stored thereon and a logic system comprising at least one logic device configured to: receive, from a portable device and via the interface system, first player characterization data for a player who is not participating in a player loyalty session at a first wagering location, search stored player characterization data to determine whether the first player characterization data match stored player characterization data and transmit, via the interface system, at least one of a player identifier and matching player characterization data to the portable transaction device according to the result of the searching step.

The present invention other hardware configured to perform the methods of the invention, as well as software stored in a machine-readable medium (e.g., a tangible storage medium) to control devices to perform these methods.

These and other features will be presented in more detail in the following detailed description of the invention and the associated figures.

BRIEF DESCRIPTION OF THE DRAWINGS

The accompanying drawings, which are incorporated into and constitute a part of this specification, illustrate one or more example embodiments and, together with the description of example embodiments, serve to explain the principles and implementations.

DETAILED DESCRIPTION

Embodiments are described herein in the context to virtually tracking un-carded or anonymous patron session data. The following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The present invention relates to tracking player gaming sessions for un-carded or anonymous players. An anonymous player may be any player whose player session can not be tracked as further discussed below.

Figure 1:
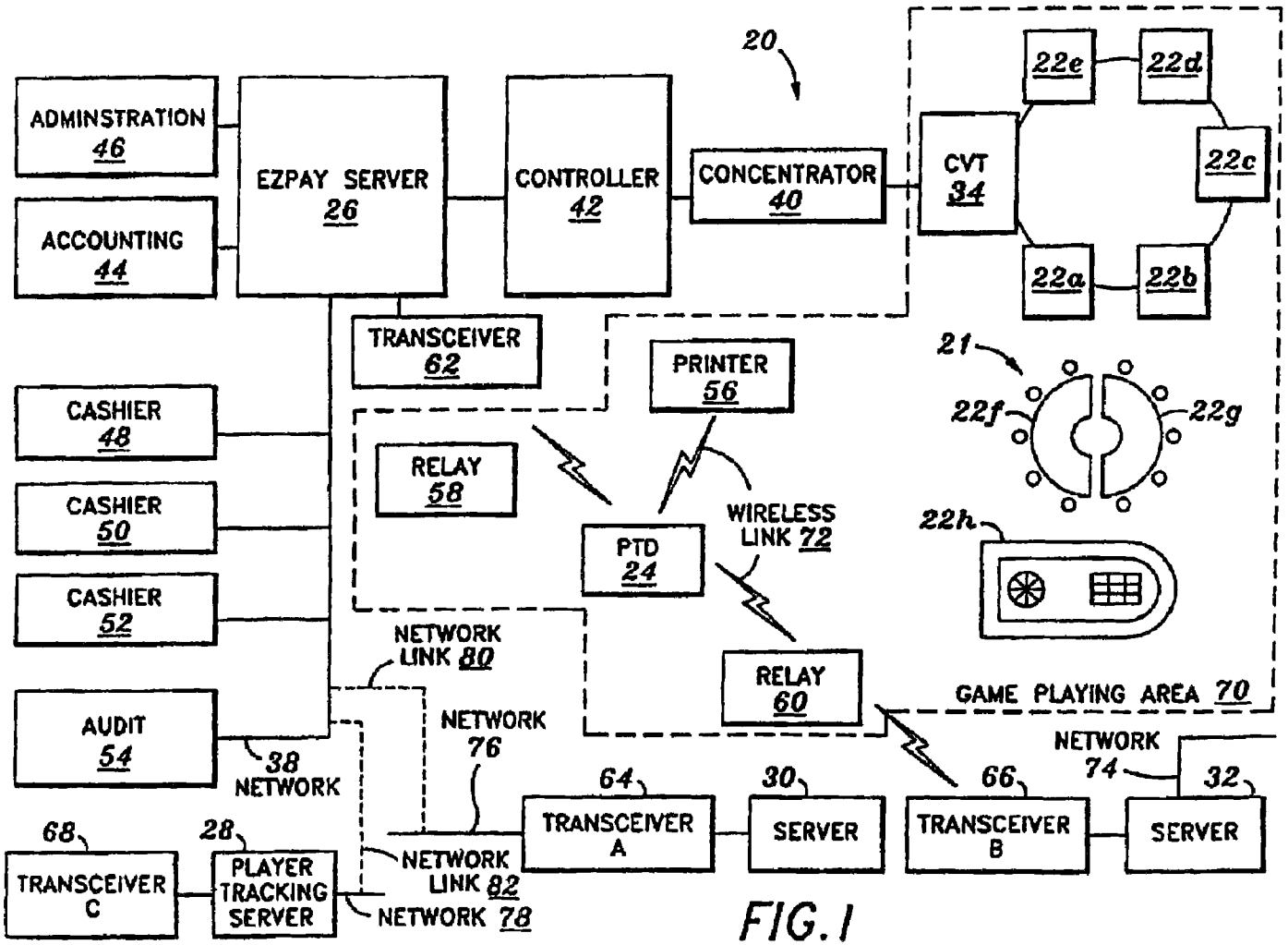
FIG. 1 is a block diagram of a gaming system in accordance with an embodiment of the invention.

FIG. 1 is a block diagram of a gaming system 20 of a gaming environment in accordance with one embodiment of the invention. The various aspects of the gaming system will first be described in overview, and then in more detail below.

As illustrated, the gaming system 20 includes a plurality of gaming machines 22*a*, 22*b*, 22*c*, 22*d*, 22*e*. In general, the gaming machines 22*a*, 22*b*, 22*c*, 22*d*, 22*e* are arranged to present one or more games to a player. Preferably, the games are of the type requiring the placement of a wager or bet and are of the type by which a player receiving a winning outcome is provided an award, such as a monetary award. These devices may comprise electrical, mechanical or electromechanical devices, such as video poker and slot machines.

In addition, the gaming system 20 includes a plurality of table games or devices 22*f*, 22*g*, 22*h*. A variety of games may be presented to one or more players at these tables. These games may include Roulette, Baccarat, Blackjack, Pai Gow and others.

In an embodiment, the gaming machines 22*a*, 22*b*, 22*c*, 22*d*, 22*e* are electronically controlled and in communication with one or more other devices. In one embodiment, the gaming machines 22*a*, 22*b*, 22*c*, 22*d*, 22*e* are in communication with a payment system referred to herein as the "EZ-Pay" system. This system includes a server 26 for receiving and transmitting information. In general, the EZ Pay system is utilized to accept payment from a player for the playing of games and obtaining of other goods and services, and for paying a player winnings or awards.

In the embodiment illustrated, the gaming system 20 includes other servers 30,32 for transmitting and/or receiving other information, processing information, storing information, and engaging in other functions. In one embodiment, as described below, one server 30 may comprise a prize transaction server. Another server 32 may comprise a food transaction server. As described in greater detail below, the gaming system 20 includes a player tracking server 28 as well. Preferably, each of the gaming machines 22*a*, 22*b*, 22*c*, 22*d*; 22*e* are in communication with the player tracking server 28. Other servers may be provided. The servers may have a variety of configurations. In one embodiment, the servers comprise computing devices and include a processor, memory and a communication interface.

The EZ Pay system will now be described in more detail with reference to FIG. 2. In general, the EZ Pay system is an award ticket system that allows award ticket vouchers to be dispensed in lieu of the traditional coin awards or reimbursements when a player wins a game or wishes to cash out. These tickets may also be used by gaming machines and other devices for providing value, such as for payment of goods or services including as a bet or ante for playing a game.

Figure 2:
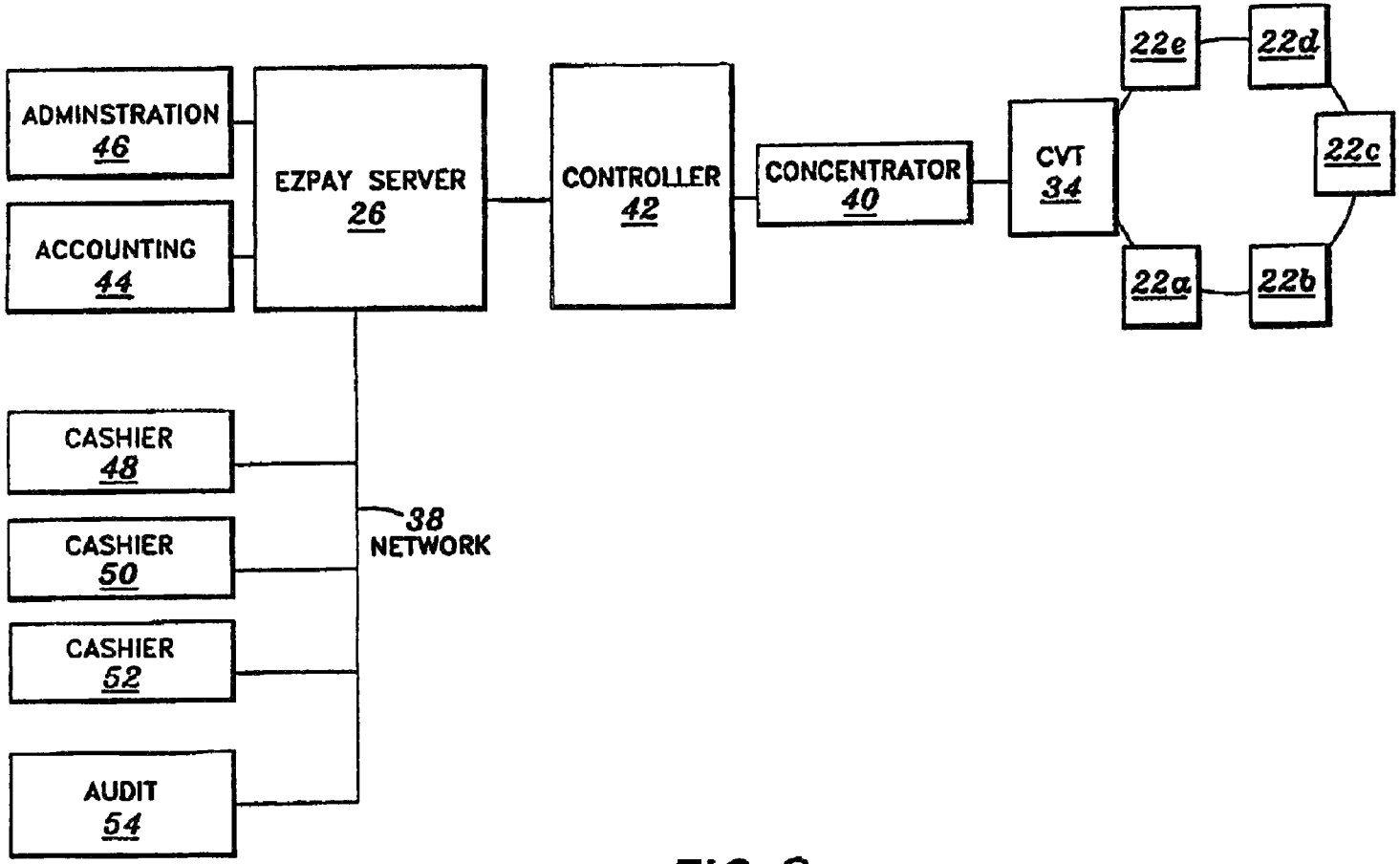
FIG. 2 is a block diagram of a payment system forming a part of the gaming system illustrated in FIG. 1.

FIG. 2 illustrates one embodiment of such a system in block diagram form. As illustrated, the gaming machines 22*a*, 22*b*, 22*c*, 22*d*, 22*e* are shown connected to a clerk validation terminal (CVT) 34. All of the gaming machines 22*a*, 22*b*, 22*c*, 22*d*, 22*e* print ticket vouchers which may be exchanged for cash or accepted as credit or indicia in other gaming machines.

The CVT 34 stores ticket voucher information corresponding to the outstanding ticket vouchers that are waiting for redemption. This information is used when the tickets are validated and cashed out. The CVT 34 stores the information for the ticket vouchers printed by the gaming machines connected to the CVT 34. To cash out the ticket voucher, the ticket voucher is validated by comparing information obtained from the ticket with information stored with the CVT 34. After a ticket voucher has been cashed out, the CVT 34 marks the ticket as paid in a database to prevent a ticket voucher with similar information from being cashed multiple times.

Multiple groups of gaming machines may be connected to a plurality of CVTs, and the multiple CVTs may be connected together in a cross validation network 38. The cross validation network typically comprises one or more concentrators 40 which accept input from the CVTs and enables communications to and from the CVTs using one communication line. The concentrator 40 is connected to a front end controller 42 which may poll the CVT(s) 34 for ticket voucher information. The front end controller 42 is connected to the EZ pay server 26 which may provide a variety of information services for the award ticket system including accounting 44 and administration 46.

The cross validation network 38 allows ticket vouchers generated by any gaming machine connected to the cross validation network 38 to be accepted by other gaming machines in the cross validation network 38. Additionally, the cross validation network 38 allows a cashier at a cashier station 48,50,52 to validate any ticket voucher generated from a gaming machine within the cross validation network 38. To cash out a ticket voucher, a player may present a ticket voucher at one of the cashier stations 48,50,52. Information obtained from the ticket voucher is used to validate the ticket by comparing information on the ticket with information stored on one of the CVTs 34 connected to the cross validation network 38. As tickets are validated, this information may be sent to another computer 54 providing audit services As described in greater detail below, the electronically controlled gaming devices 22*a*, 22*b*, 22*c*, 22*d*, 22*e* are preferably linked to the player tracking server 28 and other servers 30,32.

The table games, such as presented at the card tables 22*f*, 22*g* and Roulette table 22*h* may or may not be electronically controlled. If not electronically controlled, in one embodiment, these table games are not directly connected to the EZ Pay server 26. Likewise, the table games are not directly connected to the player tracking server 28 or other servers 30,32. However, a means is provided, as disclosed below, for providing game play and player information regarding those table games 22*f*, 22*g*, 22*h* and engaging in other functions related to those table games to other parts of the gaming system 20, such as the player tracking server 28

In one or more embodiments of the invention, this means comprises one or more portable transaction devices (PTDs) 24. The PTDs 24 are described in detail below. In one embodiment, the PTD 24 is a portable device capable of transmitting and receiving information via a wireless communication link/network.

Figure 3:
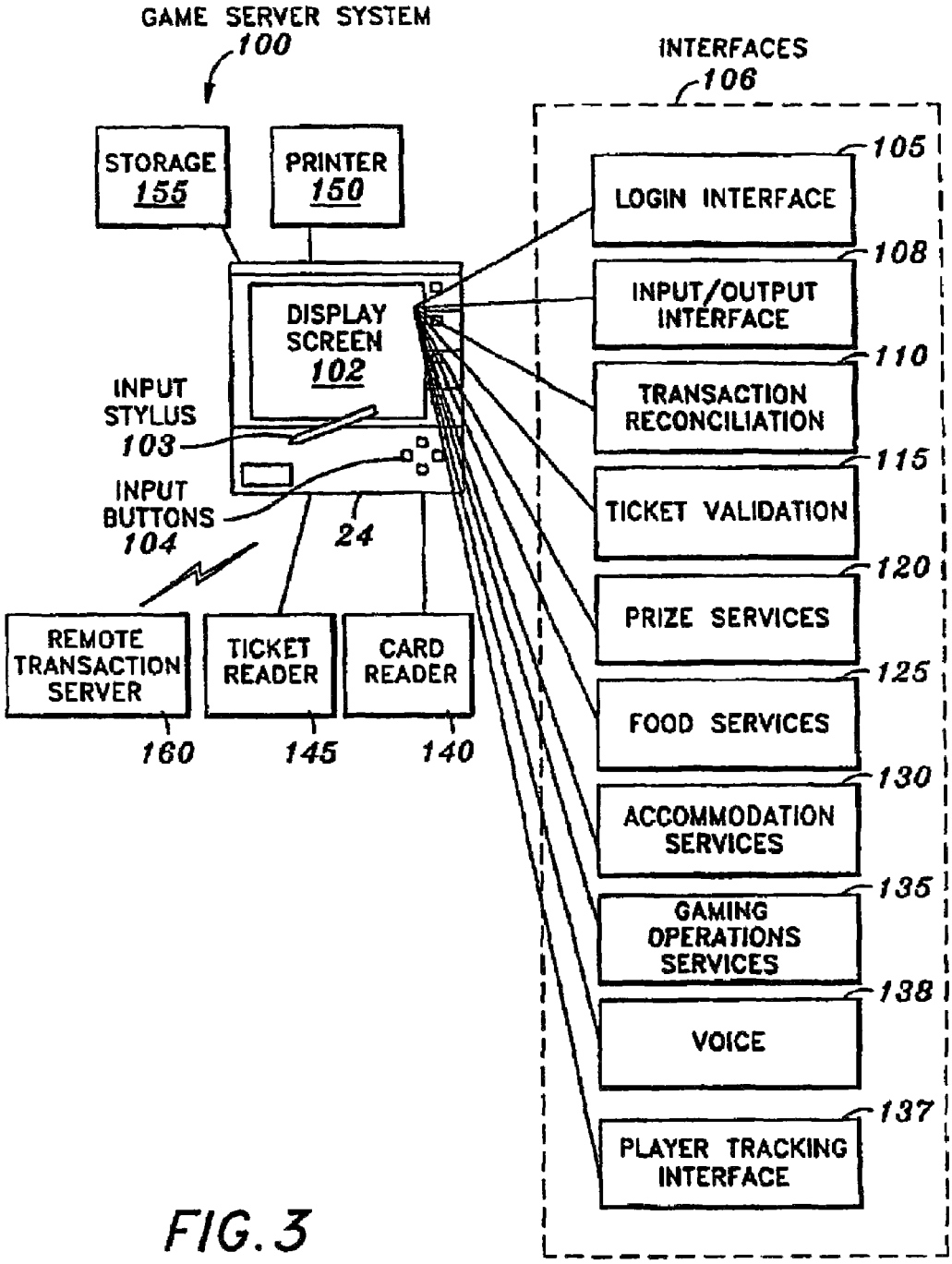
FIG. 3 is a schematic diagram of a portable transaction device of the gaming system illustrated in FIG. 1.

Referring again to FIG. 1, the gaming system 20 also preferably includes a printer 56, wireless communication relays 58 and 60, and wireless transceivers 62,64,66 and 68 connected to the remote servers 26,28,30 and 32. The functions of these various additional components are described below. In general, however, a gaming operator may obtain a PTD 24 and associate table game information with the remainder of the gaming system 20, and be provided with information from other components of the system. The gaming system 20 may include a wide variety of devices or components not illustrated or described herein FIG. 3 illustrates one embodiment of the PTD 24 and a block diagram of a transaction system 100 which may be implemented by the gaming system 20 illustrated in FIG. 1. In one embodiment, the transaction system 100 is comprised of at least one PTD 24 and a number of input and output devices. The PTD 24 is generally comprised of a display screen 102 which may display a number of game service interfaces 106. These game service interfaces 106 are generated on the display screen 102 by a microprocessor of some type (not shown) within the PTD 24. Examples of a hand-held PTD 24 that may accommodate the game service interfaces 106 shown in FIG. 3 are manufactured by Symbol Technologies, Incorporated of Holtsville, N.Y. The interface or menu data may be stored in a local memory, or the data may be transmitted to the PTD 24 from a remote location (such as a data server). This reduces the memory requirement of the device.

The service interfaces 106 may be used to implement a variety of functions, such as providing a variety of game service transactions and gaming operations services, including the tracking of player play of table games. The game service interfaces 106, including a login interface 105, an input/output interface 108, a transaction reconciliation interface 110, a ticket validation interface 115, a prize services interface 120, a food services interface 125, an accommodation services interface 130, a gaming operations interface 135, and a player tracking interface 137 may be accessed via a main menu with a number of sub-menus that allow a game service representative to access the different display screens relating to the particular interface.

In one or more embodiments, some or all of the interfaces may be available to a user of the PTD 24. Access to the interfaces 106 may depend on a variety of circumstances, such as the status or identification of the operator. In one or more embodiments, only certain interfaces 106 may be displayed depending on the status of the user of the PTD 24. In one embodiment, the particular interfaces 106 that are displayed and thus accessible for use are determined by the status of the user as indicated through a login function. In a preferred embodiment, when the PTD 24 is operable (such as when a power button is activated) the default status for the PTD 24 is the display of the login interface 105. Once a user of the PTD 24 has logged in, then the status of the PTD display is changed.

In one or more embodiments, the login interface 105 may allow a game service representative or other operator to enter a user identification of some type and in one embodiment, verify the user identification with a password. When the display screen 102 is a touch screen, the user may enter the user/operator identification information on a display screen comprising the login interface 105 using an input stylus 103 and/or using one or more input buttons 104. Using a menu on the display screen of the login interface 105, the user may select other display screens relating to the login and registration process. For example, another display screen obtained via a menu on a display screen in the login interface may allow the PTD 24 to scan a finger print of the game service representative for identification purposes or scan the finger print of a game player.

In the event a user identifies themselves as a gaming operator or representative, then the PTD 24 may be arranged to display one or more other interfaces such as those listed above and described in detail below.

In one embodiment, the PTD 24 includes a ticket reader 145 and a card reader 140. The ticket reader 145 may be of a variety of types. In one embodiment, the reader comprises a bar-code reading optical scanner. In this arrangement, a user of the PTD 24 may simply pass an employee badge that is bar-coded, in front of the bar-code reader. In one embodiment, the card reader 140 comprises a magnetic-stripe card type reader for reading information associated with an employee identification card including a magnetic stripe. An employee may be required to enter a password or other confirmation to confirm that the employee badge that is being used to gain access to the PTD 24 has not been stolen or used by an unauthorized person.

After having provided the appropriate authorization, access may be provided to the user of the PTD 24 of one or more of the following interfaces 106. Other forms of authorization may be utilized, including a variety of other biometric identifiers (such as a retinal scan or, as described above, a fingerprint). Biometric or other identifiers may be used alone or in conjunction with passwords. It will be appreciated that these forms or authorization may be utilized with other devices of the system 20 where security is required.

In one or more embodiments, an authorized user may be provided with access to the input/output interface 108. In one or more embodiments, the input/output interface 108 permits a user to select, from a list of devices stored in memory on the PTD 24, a device from which the PTD may input game service transaction information or output game service transaction information. For example, the PTD 24 may communicate with the ticket reader 145. As another example, the PTD 24 may input information from the card reader 140. Such input may be useful, for example, if a game service operator wishes to verify the authenticity of a player tracking card or the like.

The PTD 24 may output game and service transaction information to a number of devices. For example, to print a receipt, the PTD 24 may output information to a printer 150. In this game service transaction, the PTD 24 may send a print request to the printer 150 and receive a print reply from the printer 150. The printer 150 may be a large device at some fixed location or a portable device carried by the game service representative. As another example, the output device may be the card reader 140 that is able to store information on a magnetic card or smart card. Other devices which may accept input or output from the PTD 24 are personal digital assistants, microphones, keyboard, storage devices, gaming machines and remote transaction servers.

The PTD 24 may communicate with the various input mechanisms and output mechanisms using both wire and wireless communication interfaces. For example, the PTD 24 may be connected to the printer 150 by a wire connection of some type. However, the PTD 24 may communicate with a remote transaction server 160 via a wireless communication interface including a spread spectrum cellular network communication interface. An example of a spread spectrum cellular network communication interface is Spectrum 24 offered by Symbol Technologies of Holtsville, N.Y., which operates between about 2.4 and 2.5 Gigahertz. The information communicated using the wireless communication interfaces may be encrypted to provide security for certain game service transactions such as validating a ticket for a cash payout. Some devices may accommodate multiple communication interfaces. Such a spread spectrum network is but one possible communication scheme.

In one or more embodiments, each PTD 24 may have a unique identifier that is utilized to identify which PTD 24 data is transmitted from and to which data is to be transmitted to.

Another type of interface that may be stored on or presented at the PTD 24 is the award ticket validation interface 115. One embodiment of the award ticket interface 115 may accommodate the EZ pay ticket voucher system and validate EZ pay tickets as previously described. However, when other ticket voucher systems are utilized, the award ticket validation interface 115 may be designed to interface with the other ticket voucher systems. Using the award ticket validation interface 115, a game service representative may read information from a ticket presented to the game service representative by a game player using the ticket reader and then validate and pay out an award indicated on the ticket.

Typically, the award ticket contains game service transaction information that may be verified against information stored on the remote transaction server 160. A number of game service transactions may be required to validate the ticket. For example, after obtaining game service transaction information from the award ticket, the PTD 24 may send a ticket validation request to the remote transaction server 160 using the spread spectrum communication interface and receive a ticket validation reply from the remote server 160. In particular, the validation reply and the validation request may be for an EZ Pay ticket. After the award ticket has been validated, the PTD 24 may send a confirmation of the transaction to the remote server 160. Details of the game service transaction information validation process are described with reference to FIG. 4. In other embodiments, the award ticket interface 115 may be configured to validate award information from a smart card or some other portable information device or validate award information directly from a gaming machine.

As game, service and other transactions or events are completed, game and service transaction information may be stored on a storage device 155. The storage device 155 may be a remote storage device or a portable storage device. The storage device 155 may be used as a back-up for auditing purposes when the memory on the PTD 24 fails and may be removable from the PTD 24.

Another type of game service interface that may be stored on or presented at the PTD 24 is the prize service interface 120. As an award on a gaming machine (i.e., machines 22*a*, 22*b*, 22*c*, 22*d*, 22*e* in FIG. 1), a game player may receive a ticket that is redeemable for merchandise including a bicycle, a computer or luggage. Using the prize service interface 120, a game service representative may validate the prize service ticket and then check on the availability of certain prizes. For example, when the prize service ticket indicates the game player has won a bicycle, the game service representative may check whether the prize is available in a nearby prize distribution center. In one embodiment, a player may be awarded a prize of a particular level, there being one or more particular prizes on that level. In such event, the user may use the prize interface 120 to determine what prizes are currently available in the prize level just awarded. The PTD 24 may validate a prize ticket and check on the availability of certain prizes by communicating with a remote prize server. Further, the game service representative may have the prize shipped to a game player's home or send a request to have the prize sent to a prize distribution location. The game service transactions needed to validate the prize ticket including a prize validation request and a prize validation reply, to check on the availability of prizes and to order or ship a prize may be implemented using various display screens located within the prize interface 120. The different prize screens in the prize service interface 120 may be accessed using a menu located on each screen of the prize service interface 120. In other embodiments, the prize service interface 120 may be configured to validate prize information from a smart card or some other portable information device or validate award information directly from a gaming machine.

Another type of game service interface that may be stored on or presented at the PTD 24 is the food service interface 125. As an award on a gaming machine or as compensation for a particular amount of game play, a game player may receive a free drink or food. Using the food service interface 125, a game service representative may validate such an award (for example, the award may be provided to a player of the gaming device 22*a* in the form of a ticket) and check on the availability of the award. For example, when the game player has received an award ticket valid for a free meal, the food service interface 125 may be used to check on the availability of a dinner reservation and make a dinner reservation. As another example, the PTD 24 may be used to take a drink or food order. Such an order may be processed via the remote food server 32 (see also FIG. 1). The transactions needed to validate a food ticket or award, to check on the availability of food services, request a food service and receive a reply to the food service request may be implemented using various display screens located within the food service interface 125. These display screens may be accessed using a menu located on each screen of the food service interface 125. In other embodiments, the food service interface 125 may be configured to validate food service information from a smart card or some other portable information device.

Another type of game service interface that may be stored on or presented at the PTD 24 is an accommodation service interface 130. As an award for game play or as compensation for a particular amount of game play, a game player may receive an award in the form of an accommodation service such as a room upgrade, a free night's stay or other accommodation prize. Using the accommodation service interface 130, the user may check on the availability of certain accommodation prizes. For example, when the game player has received an award for a room upgrade, the accommodation service interface 130 may be used to check on the availability of a room and to make a room reservation. Regardless of whether the player has won an accommodation award, the user of the PTD 24 may utilize the accommodation service interface 130 to reserve a room (such as an additional night's stay) or an upgrade to a room. In one embodiment, a player of a game may be issued a ticket (such as from a gaming machine 22*a*, 22*b*, 22*c*, 22*d*, 22*e* in FIG. 1), and a gaming representative may use the accommodation service interface 130 in order to validate the player's award ticket and check on the availability of the award and institute the award. As another example, the PTD 24 may be used to order a taxi or some other form of transportation for a player at a gaming machine preparing to leave the game playing area. The game playing area may be a casino, a hotel, a restaurant, a bar or a store. This or another interface of the PTD 24 may be used to implement/obtain other services, such as to transmit a message to an automobile valet service requesting that the user's car be obtained for use.

The PTD 24 may be used to validate the accommodation service award and check on the availability of certain accommodation awards by communicating with a remote accommodation server. The transactions needed to validate the accommodation ticket, check on the availability of accommodation services, request an accommodation service and receive a reply to the accommodation service request may be implemented using various display screens located within the accommodation service interface 130. These display screens may be accessed using a menu located on each screen of the accommodation service interface 130. In other embodiments, the accommodation service interface 130 may be configured to validate accommodation service information from a smart card or some other portable information device.

Another type of game service interface that may be stored on or presented at the PTD 24 is a gaming operations service interface 135. Using the gaming service interface 135 on the PTD 24, a game service representative may perform a number of game service transactions relating to gaming operations. A number of such transactions are disclosed in greater detail below. Generally, however, there may be a variety of such transactions that may be accomplished or implemented via the PTD 24. The interface 135 may be adapted to permit the user of the PTD 24 to provide game related information or request game related information. For example, a user may request a fill or credit transaction at a gaming table. A user may also utilize the PTD 24 to provide information related to the opening or closing of a gaming table. Using this interface 135, the user may obtain specific game rules or calculate bet payoffs. The user may trigger a request for additional security. The user may also enter information regarding player traffic or headcount.

The user may utilize the gaming operations service interface 135 to request maintenance or other services. For example, if a game player has spilled a drink in the game playing area, a game service representative may send a request to maintenance to have someone clean up the accident and receive a reply from maintenance regarding their request. The maintenance request and maintenance reply may be sent and received via display screens selected via a menu on the screens of the gaming operations service interface 135. As another example, when a game service representative observes a damaged gaming machine such as a broken light, the game service representative may send a maintenance request for the gaming machine using the PTD 24.

Another type of game service interface that may be stored on or presented at the PTD 24 is a transaction reconciliation interface 110. Typically, the PTD 24 contains a memory storing game service transaction information. The memory may record the type and time when particular game service transactions are performed. At certain times, the records of the game service transactions stored within the PTD 24 may be compared with records stored at an alternate location. For example, for an award ticket validation, each time an award ticket is validated and paid out, a confirmation is sent to the remote server 160. Thus, information regarding the award tickets, which were validated and paid out using the PTD 24, should agree with the information regarding transactions by the PTD 24 stored in the remote server 160. The transaction reconciliation process involves using the transaction reconciliation interface 110 to compare this information.

Another type of game service interface that may be stored on or presented at the PTD 24 is a voice interface 138. Using the spread spectrum cellular or other communication network incorporated into the PTD 24, a game service representative may use the PTD 24 as a voice communication device. This voice interface 138 may be used to supplement some of the interfaces previously described. For example, when a game player spills a drink the game service representative may send a maintenance request and receive a maintenance reply using the voice interface 138 on the PTD 24. As another example, when a game player requests to validate a food service such as free meal, such a request may be made by the game service representative at a restaurant or other location using the voice interface 138 on the PTD 24.

Another type of game service interface that may be stored on or presented at the PTD 24 is the player tracking interface 137. Preferably, the player tracking interface 137 may be used by the game service representative or other operator to input game play, player and other information, and view game play, player and other information. For example, the player tracking interface 137 may be used to input player game play information to the player tracking server 28 for use by the casino in issuing the player "comps" or other rewards. The player tracking interface 137 may also be used to enter table game data that is used in accounting and other reconciliation and monitoring functions. The player tracking interface 137 may also be used by the operator to obtain information, such as player identification information for use in monitoring players.

In one embodiment, the player tracking interface may receive information from a card reading device (e.g., 140) connected to the PTD 24. The card reading device may read information from a card, such as a driver's license, using optical character recognition (OCR). In one embodiment, a card reading system from Card Scanning Solutions (Los Angeles, Calif.) may be used.

The card reading device may be used to quickly and accurately read the information from driver licenses, medical insurance cards and other ID cards using OCR. For example, to initiate a session in a rewards program or register for the rewards program, the player may simply hand the player their drivers license, pass port or other ID card and the information from the ID card may be scanned in and formatted in the PTD 24 for communication with a remote transaction server, such as a player tracking server. It is noted that in general, "a player" refers to any person that a user of the PTD 24 may encounter in within the working range of the PTD 24 (e.g., within the game playing area). The player does not necessarily have to be playing a game of chance or be participating in a game playing activity when the PTD 24 is utilized.

The ID card may include information, such as a photograph, that may be digitally scanned in by the card reader and stored to a player identification file. The digital photograph may be later used for a number of purposes. For example, PTD may be operable to display a picture of the player, which may be used by employee using the PTD 24 to identify the person of interest. In another embodiment, the photograph may be used to generate an instrument with the players photograph on it. For example, the instrument may be a rewards card embossed with the player's photo.

When the player's photo is stored in the player's identification file, an award ticket voucher, a prize ticket, a promotion ticket or voucher for a "comp" may be printed with the player's photo embossed on the ticket voucher. For example, when a game player has finished playing a game on the gaming machine and decides to cash out, the digital photo information may be obtained from the game player's player information file and printed on an award ticket voucher issued from the gaming machine or the gaming device, where the voucher is issued, may include a digital camera.

The photo on the award ticket voucher may be later used for authentication purposes when the player attempts to validate the award ticket voucher. Details of this validation process are described below. In one instance, the player may present the award ticket voucher to an employee using the PTD 24 for validation. The employee may decide to validate the award ticket voucher depending on whether the photo on the award ticket voucher matches the person that has presented the award ticket voucher for validation. For example, when the photo on the award ticket voucher and the person that has presented the voucher do not match, the employee using the PTD 24 may refuse to validate the award ticket voucher. In one embodiment, the validation of award ticket vouchers over a certain amount may require a photographic authentication that is done by a person where a photo is included on the printed voucher when it is issued.

In another embodiment, the photo may be printed on an award ticket voucher for entertainment purposes. A gaming device, such a gaming machine, may include printing software for a number of templates that may incorporate a player's photograph. For example, the gaming machine may include software for a template that prints a ticket voucher that resembles a design seen on currency. Thus, an award ticket voucher may be printed that resembles a "US dollar" bill with the player's photograph replacing the picture of the president. The template may also include other player information, such as the player's name.

In yet another embodiment, the PTD 24 may include a built in camera. The camera may be used to take a player's photograph when they provide information to a user of the PTD 24. Again, this photograph may be stored in the player's identification file.

In one embodiment, an optical character recognition device may eliminate the need for using magnetic strip or barcode readers or an optical character recognition device may be used with other information input devices. For example, an OCR device may be used in combination with a bar-code scanner and magnetic stripe reader. In one embodiment, the PTD 24 may be operable to scan bar-codes formatted using two-dimensions.

In general, card reading devices 140 may be used 1) to scan driver's licenses and ID cards from all 50 states and to capture image, data and ID text using OCR, 2) to read Driver's license magnetic strip information, 3) to scan passports and process it to text information through OCR or 4) to scan or read any other type of commonly used identification cards (e.g., credit cards, mileage cards and other reward program cards). In another embodiment, the PTD 24 may be operable to electronically download information from an information device carried by the player, such as cell phone, PDA, hand-held computer or smart card.

Also, the present invention is not limited to receiving information that may be scanned from an ID card, such as driver's licenses, credit cards or a passport. Other examples of information that may be input into the PTD 24 include but are not limited to player habits, behaviors, actions, preferences, style, etc. The PTD 24 may be operable to generate one or more interfaces for inputting this information. This information may characterize a player's behaviors and preferences while they are in a game playing area. Thus, a casino may use this information to provide more personalized services to the player.

Player habits, actions, preferences, style may describe details about a) a player's dressing style, such as clothing type, clothing brands, jewelry, hat, sunglasses, b) whether the player is dressed casually, fashionably, suit and tie, etc., c) what the player likes to eat or where the player likes to eat, d) whether the player smokes or does not smoke, e) what time or day the player is playing, f) what the player drinks, g) how much the player drinks, h) what type of games the player likes to play, such as particular slot games or table games, i) how long the player has played, j) where they were born or where they currently live, k) marital status, l) whether the player talks a lot or is quiet, m) whether the player makes impulsive bets or plays conservatively, n) how the player bets when they are winning or losing, o) how the player reacts when they win or lose, p) whether the player tips the dealer or the cocktail waitress and how much the player tips, q) whether the player plays alone or with friends, r) whether the player is carrying a cell phone, s) what amount does the player usually buy-in with to a table game or a slot machine (e.g., $100, $50, etc.), t) player physical characteristics (e.g., approximate age, weight, hair color, eye color), u) a player's profession and v) whether the player is with a particular group or attending a particular convention.

The information may be gathered from the player using the PTD 24 in an active or a passive manner. An active input of information may involve an active interaction between the player and the user of the PTD 24, such as where the user of the PTD 24 receives information from the player while actively asking the player questions. In one embodiment, the PTD 24 may include a digital voice recorder for recording a player's responses. A passive input of information may involve the user of the PTD 24 observing the player and inputting information based on their observations of the player.

In one embodiment of the present invention, the PTD 24 may be operable to generate an interface that allows a user to enter information that relates the player to other people. For example, if the player is playing with friends, information may be entered that establishes links between the player and his friends. As another example, if the player likes a particular dealer, waitress or other person working in the game playing area, then this information may be entered into the PTD 24 via an appropriate interface. In another example, if the player is willing to provide information about their friends and family or the player is with friends and family then this information may be entered into the PTD 24.

As will be appreciated by those of skill in the art, the PTD 24 may have a variety of configurations. For example, interface information need not be stored at the PTD 24 but may be stored elsewhere and transmitted to the PTD 24. In such an embodiment, the PTD 24 may have a much more limited amount of data memory. In one embodiment, the PTD 24 includes a processor for executing control code, such as that necessary to operate the display 102, accept input from the stylus 103 or input buttons 104 or the like. In addition, the PTD 24 preferably includes a buffer memory for accepting data transmitted from the game server 28. This data may comprise data for displaying game information, such as video and sound content.

Various aspects of the use of the PTD 24 described above will now be described. In one or more embodiments, an operator may use the PTD 24 to track player game play, issue and redeem tickets, and obtain products and services, such as food, for players. In addition, an operator may utilize the PTD 24 to input information regarding table game activity. Several examples of a method of such use are detailed below in conjunction with FIGS. 4 through 6.

When a game service representative contacts a game player seeking a game service or other service in a game playing area 70 (see FIG. 1), the game service representative uses an appropriate game service interface 106 on the display screen of the PTD 24, as described with reference to FIG. 3, to provide the game service requested by the game player. For example, when a game player requests an EZ Pay ticket validation, the game service representative brings the EZ Pay ticket validation interface 115 onto the display screen of the PTD 24 using menus available on the display screen 102. Then, the game service representative scans the EZ Pay ticket using a ticket reader connected to the PTD 24 to obtain unique ticket information. Next, the PTD 24 sends an EZ Pay ticket validation request using the wireless communication interface to the EZ Pay server 26.

Typically, the ticket validation request is composed of one or more information packets compatible with the wireless communication standard being employed. Using a wireless link 72, the one or more information packets containing the ticket validation request are sent to the transceiver 62 connected to the EZ Pay server 26. The transceiver 62 is designed to receive and send messages from the one or more PTDs 24 in the game playing area 70 in a communication format used by the PTDs 24. Depending on the location of the PTD 24 in the game playing area 70, the communication path for the information packets to and from the PTD 24 may be through one or more wireless communication relays including 58 and 60. For example, when the PTD 24 is located near gaming machine 22*a*, the communication path for a message from the PTD 24 to the EZ Pay server 26 may be from the PTD 24 to the relay 60, from the relay 60 to the relay 58, from the relay 58 to the transceiver 62 and from the transceiver 62 to the EZ Pay server 26. As the location of the PTD 24 changes in the game playing area 70, the communication path between the PTD 24 and the EZ Pay server 26 may change.

After receiving an EZ Pay ticket validation reply from the EZ Pay server 26, the EZ Pay ticket may be validated using an appropriate display screen on the PTD 24. After cashing out the ticket, the game service representative may send a confirmation of the transaction to the EZ Pay server 26 using the PTD 24. The transaction history for the PTD 24 may be stored on the PTD 24 as well as the EZ Pay server 26. Next, a receipt for the transaction may be printed out. The receipt may be generated from a portable printer carried by the game server representative ad connected to the PTD 24 in some manner or the receipt may be generated from a printer 56 at a fixed location.

After providing a number of game services comprising a number of game service transactions to different game players in the game playing area 70 using the PTD 24, a game service representative may log-off of the PTD 24 and return it to a location for secure storage. For example, at the end of a shift, the game service representative may return the PTD 24 at one of the locations, for use by another game service representative. However, before the PTD 24 is assigned to another game service representative, the transaction history stored on the PTD 24 may be reconciled with a separate transaction history stored on a transaction server such as the EZ Pay server 26.

The assigning and unassigning of the PTD 24 to a game service representative and the transaction reconciliation are performed for security and auditing purposes. Another security measure that may be used on the PTD 24 is a fixed connection time between the PTD 24 and a transaction server. For example, after the PTD 24 has been assigned to a game service representative and the game service representative has logged on the PTD 24, the PTD 24 may establish a connection with one or more transaction servers including the EZ Pay server 26, the player tracking server 28, or the other servers 30,32. The connection between a transaction server and the PTD 24 allows the PTD 24 to send information to the transaction server and receive information from the transaction server. The length of this connection may be fixed such that after a certain amount of time the connection between the PTD 24 and the transaction server is automatically terminated. To reconnect to the transaction server, the login and registration process must be repeated on the PTD 24.

A transaction server may provide one or more game service transactions. However, the PTD 24 may connect with multiple transaction servers to obtain different game service transactions. For example, the server 30 may be a prize transaction server allowing prize service transactions and server 32 may be a food transaction server allowing food service transactions. When a game service representative receives a prize service request from a game player, the PTD 24 may be used to contact the prize transaction server 30 using a wireless communication link between the PTD 24 and the transceiver 64 connected to the prize transaction server 30. Similarly, when a game service representative receives a food service request from a game player, the PTD 24 may be used to contact the food transaction server 32 using a wireless communication link between the PTD 24 and the transceiver 66 connected to the food transaction server 32.

The different transaction servers including the servers 26, 28, 30, 32 may be on separate networks or linked in some manner. For example, server 32 is connected to network 74, server 26 is connected to network 38, server 30 is connected to network 76, and the player tracking server 28 is connected to a player tracking network 78. In this embodiment, a network link 80 exists between network 76 and network 38. Thus, server 26 may communicate with server 30 via the network link 80. A communication link between different servers may allow the servers to share game service transaction information and allow different communication paths between the PTDs and the transaction servers. Likewise, a network link 82 exists between network 78 and network 38, permitting the game server to communicate with the EZ Pay server 26 and the other servers 30,32 via the link 80.

Figure 4:
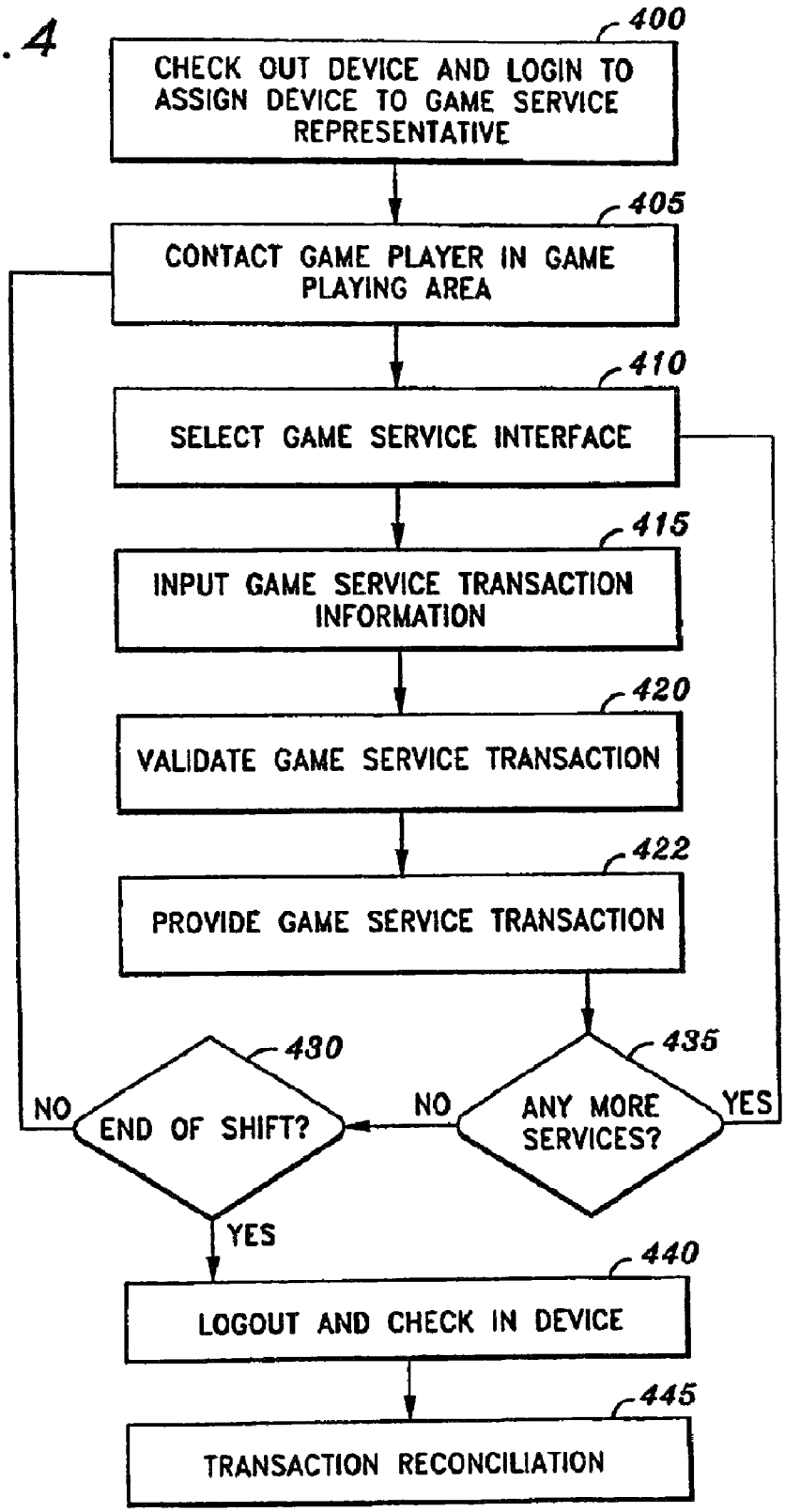
FIG. 4 is a flow diagram of a method of use of the portable transaction device of the invention by a gaming service operator.

FIG. 4 is a flow chart depicting one embodiment of a method for providing a game service using the PTD 24. At 400, a game service representative receives the PTD 24 and logs in to the device to assign the device. The check out process and assign process are for security and auditing purposes. At 405, the game service representative contacts a game player in the game play area requesting a game service of some type. At 410, the game service representative selects an appropriate interface on the PTD 24 using menus on the display screen 102 of the PTD 24 that allow the game service representative to provide a requested game service. At 415, the game service representative inputs game service transaction information required to perform a game service transaction. For example, to validate an award ticket, the game service representative may read information from the ticket using a ticket reader. As another example, to provide a food service including dinner reservation, the game service representative may enter a game player's name to make the reservation.

At 420, the transaction information obtained at 415 is validated as required. For example, when a player attempts to cash out an award ticket, the information from the award is validated to ensure the ticket is both genuine (e.g. the ticket may be counterfeit) and has not already been validated. The validation process requires a number of transfers of information packets between the PTD 24 and the transaction server. The details of the validation process for an award ticket validation are described with reference to FIG. 6. When the transaction information is valid, At 422, a game service transaction is provided. For example, a room reservation may be made for a player requesting an accommodation service. A confirmation of the game service transaction may be sent to the transaction server for transaction reconciliation At 445. In one or more embodiments, the method may include generating a receipt regarding the game service transaction.

At 435, after providing the service, a user of the PTD 24 may request another game service. In this event, the process returns to 410 and selects an appropriate interface for the game service. When no additional service is requested and it is not the end of a shift, At 430, the game service representative returns to 405 and contacts a new game player. At 440, when a shift has ended, the game service representative logs out of the PTD 24 and checks the device at a secure location so that the PTD 24 may be assigned to a different game service representative. At 445, before the PTD 24 is assigned to a different game service representative, a transaction history reconciliation is performed to ensure that the transaction history stored on the PTD 24 is consistent with the transactions previously confirmed with a transaction server during the game service representative's shift. The transaction history on the PTD 24 may be stored on a removable memory storage device on the PTD 24. Thus, the memory may be removed from the device for transaction reconciliation and replaced with a new memory. Thus, the device with the new memory may be assigned to a new game service representative while the transaction history from the previous game service representative assigned to the device is reconciled.

Figure 5:
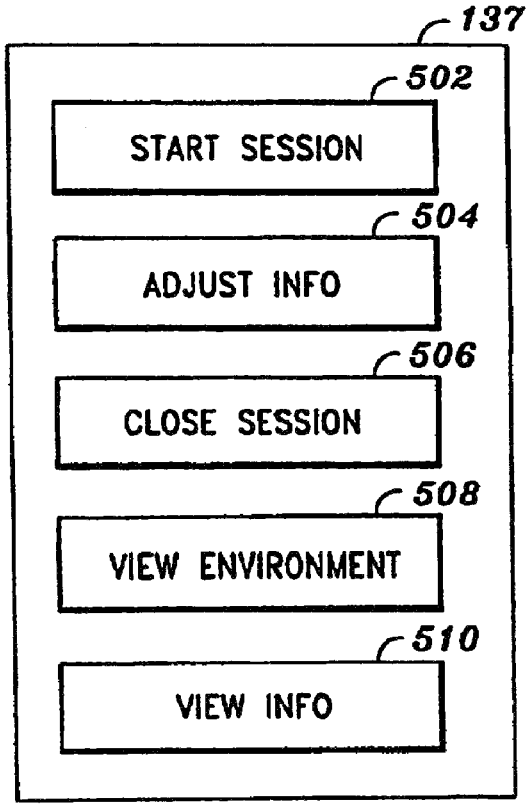
FIG. 5 illustrates an embodiment of a graphically displayed menu of player tracking functions which may be implemented using the portable transaction device of the invention.

As indicated above, the player tracking interface 137 may be used to implement a variety of player tracking and related functions. In one embodiment, the player tracking interface 137 includes a number of player tracking activity-related selections. Referring to FIG. 5, in one embodiment, when a user selects the player tracking interface 137, a menu of selections becomes available, such as by display on the display screen 102 of the PTD 24.

In one embodiment, the menu includes the selections of "start session" 502, "adjust information" 504, "close session" 506, "view environment" 508 and "view information" 510. The menu may include a lesser or greater number of selections and include selections not indicated herein. The actions initiated using each of these menu selections is detailed below. In one embodiment, before a user is permitted to select one of the menu items, the user must obtain a PTD 24 and login, as indicated at 400 of FIG. 4.

Figure 5A:
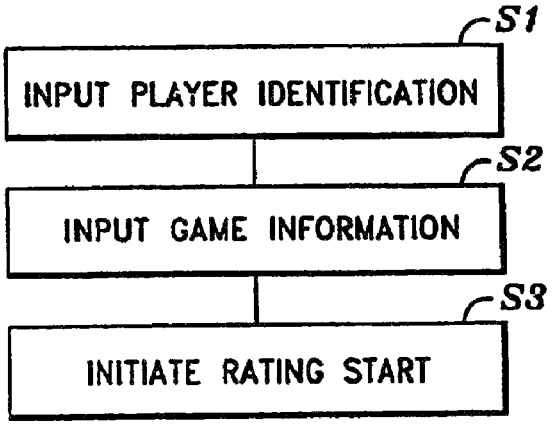
FIG. 5A is a flow chart illustrating a method of starting a player rating session in accordance with one of the functions of the menu illustrated in FIG. 5.

In one embodiment, when a user selects "start session" 502, a graphical user interface (not shown) is displayed to the user on the display screen 102 of the PTD 24. The graphical user interface may comprise an electronic "form" containing fields for the input of information. In one embodiment as shown in FIG. 5A, at St, a user inputs player identification information. This information may be input by a variety of means and include a variety of information.

In one embodiment, a player participating in a rewards program of the casino or other gaming environment may be provided with a player tracking card. This card may contain player identification information. In one embodiment, the card may include a magnetic stripe having identification information stored thereon. In this embodiment, the user of the PTD 24 may approach a player of a game and request their player tracking card. The user may scan the card using the card reader 140 of the PTD 24. Alternatively, the user may input the information manually, such as by use of the stylus 103 or buttons 104, or with a portable keyboard (not shown).

The input player identification information is preferably transmitted to the player tracking server 28 via the wireless communication link from the PTD 24 to the server 28 directly or via a relay 58 and one or more other network links. The player tracking server 28 may include a variety of player files, such as one or more files corresponding to a player and including identification information. The player identification information, such as a code stored on the player's card, may be used to access the file(s) for that player.

In one embodiment, files are provided which include information regarding a player's game play during one or more periods of time. A set of data regarding a player's game play during a period of time is referred to herein as a "rating" or "rating session." In one embodiment, one or more files contain player ratings corresponding to a player. These ratings files may be electronic files stored in an electronic folder corresponding to the player. In any case, a means is provided for identifying the player to which the rating file corresponds. As disclosed below, a variety of data may be stored in the rating file, such as length of time of play, and amounts bet and won. As is known, such information is useful to a casino in identifying players to be awarded "comps" and for a wide variety of other purposes. Individual ratings may be combined in one or more files to create an aggregate rating. The data comprising the rating may also be manipulated to generate other information.

At S2, the user inputs game information. The user may input a variety of information such as the particular game that the player is playing and the player's seating location. For example, the user may be permitted to identify that the player is seated at a $5 minimum bet gaming table. In one embodiment, as disclosed below, the gaming environment may be illustrated graphically to the user of the PTD 24 and the user may identify the location of a player, such as by using a table identification, seat identification or the like. For example, within the player tracking system all of the gaming tables and seats may be identified with unique codes, such as serial numbers. These serial numbers may be printed on the chairs and tables. A user of the PTD 24 may identify the game that the player is playing by entering the serial number for the table and/or chair.

At S3, the user starts the rating session. In one embodiment, this comprises sending a completed electronic form including the player and game information to the player tracking server 28. In another embodiment, a menu element or displayed button or the like may be utilized. In one embodiment, when the rating session is started, data regarding player play is input to a file or files associated with that rating session until the rating session is closed. Once the rating session is opened, data regarding the player's game play is sent to the player tracking server 28 and is stored in the player's file or files.

In one embodiment, when a user selects "adjust information" 504, the user of the PTD 24 is permitted to provide player information to be associated with a player rating session. This comprises, the input of player game play information. The game play information is stored in the player's file or files as part of the rating session.

The game play information may be input in a variety of manners. In general, the user of the PTD 24 will view or monitor player game play and input information regarding the game play. In another embodiment, other gaming personnel may monitor or track game play and then provide the data to the user of the PTD 24, who then inputs the information. In either event, table or other game play information is obtained, and this information is then input to the PTD 24 and transmitted via a wireless communication link to the player tracking server 28. In this manner, player game play information is tracked even through the particular game the player is playing is not of the type which permits direct electronic transmission of game play data from the gaming device to the player tracking server 28.

Figure 5B:
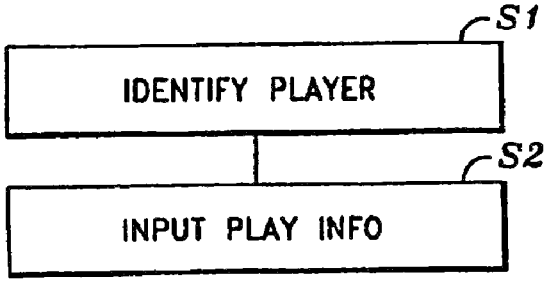
FIG. 5B is a flow chart illustrating a method of adjusting information in accordance with another of the function of the menu illustrated in FIG. 5.

One method of the function of adjusting information is illustrated in FIG. 5B. In one embodiment, when a user selects the "adjust information" 504 option, at S1, the user is prompted to identify the player whose game play information is to be updated. In one embodiment, a graphical display of the gaming environment is displayed. As stated above, when the user of the PTD 24 starts a session, an identified player is preferably associated with a particular game or game location. The user may select the gaming location at which the player is playing to identify the player.

At S2, a graphical user interface is displayed. Preferably, the graphical user interface includes information regarding a player at a selected location. In this manner, the user may verify that the game play information that is being input corresponding to a particular player matches the identity of the player in the system. In one embodiment, the player information that is available to the user may be varied. In an embodiment of the invention, when a player elects to participate in the rewards program, the player may be requested to provide a wide variety of identification information such as, but not limited to the following: name, address, birth date/age, color of hair, color of eyes, height, weight, social security number, telephone number, and email address. This information is preferably stored in a file or files corresponding to the player, such as at the player tracking server 28. In one embodiment, some or all of this information may be displayed to the user of the PTD 24. Using the provided information, the user of the PTD 24 may verify that the actual player playing the game and the identified player in the system are the same.

In one embodiment, the graphical user interface may include fields permitting the user of the PTD 24 to input player identification information, such as the player's hair color and the like. In this way, the user of the PTD 24 may update the player's identification information.

The graphical user interface also preferably includes blank fields for inputting player game play information. For example, fields may be provided for inputting average bet in dollars per hour or other time period, average win in dollars per hour or other time period, and a variety of other game play related data.

A variety of different game play information may be input or tracked using the PTD 24. The particular information that is tracked may vary dependent on a wide variety of circumstances, including the type of game the player is playing.

As one example, the PTD 24 may be used to track the play of a baccarat player. As is known, in the play of bacarrat, players generally alternate in serving as the bank. The house may be paid a commission based on player play. In some instances, the house may reward players by paying out a commission based upon the value of money wagered. During game play, monies frequently change hands, including when players give away a portion of their monies to other players and friends.

In accordance with the invention, the PTD 24 may be used to track this play, such as to ensure that the house pays the correct commission to a player based upon their wagers. In this embodiment, the user of the PTD 24 may enter player wager and money transfer information. A specific user interface may be provided for this purpose. For example, upon the user selecting "adjust information" 504, a menu may be presented to the user which allows the user to select from a number of different customized input configurations, such as "baccarat," "21," "poker" or the like.

In one embodiment, when a user selects "close session" 506, the user of the PTD 24 identifies a particular player or player session, and requests that the session be closed. A user would select this option, for example, if a player quits playing a particular game. When the user selects this option, the player's rating session is closed, preventing input of further game play data for that session. In one embodiment, when the user of the PTD 24 selects this function, a signal is transmitted to the player tracking server 28 that causes the ratings session file to be closed. Game play data regarding the player received after closure of the session is not associated with that session, but with another session. In another embodiment, at the closing of a session, input of additional information may be permitted in order to associate additional information with that session. For example, at the close of a session, a user of the PTD 24 may wish to enter information regarding amounts (either cash or chips) that a player is leaving a game with.

In one embodiment, when a user selects "view environment" 508, a graphical representation of the gaming environment is preferably displayed to the user of the PTD 24. As set forth above, the player tracking server 28 or other device may store gaming environment information. This information may comprise a two-dimensional representation of the gaming environment. The representation may include graphical representations of table games, including the gaming table per se and player seating. As indicated, this gaming equipment may be identified by a serial number or the like. Of course, the graphical representation may be arranged in a variety of manners. Regardless of the specific implementation, it is desired that the user of the PTD 24 be able to view a representation of all or a part of the gaming environment in a manner permitting the user to identify the corresponding "real" equipment. Thus, as one example, the graphically illustrated gaming equipment may be illustrated in the same layout or arrangement as the physical gaming equipment.

In one embodiment, when a user selects "view information" 510, information regarding one or more players is displayed. In one embodiment, the user is prompted to identify the player or players for which information is to be displayed. For example, the user may select a particular location from a graphical representation of the gaming environment. The user may also input a table serial number, input the player's name or provide other information identifying the player (such as physical characteristic data In response to this request, the player tracking server 28 preferably transmits the player information. The information may include player identification information as well as player gaming information, such as gaming information from a single session or more than one session.

In some situations, a player may move from one gaming table to another, or from one position at a gaming table to another position at the same table. As one aspect of the invention, the user of the PTD 24 may "move" a player when the player moves. The user of the PTD 24 may use the graphical representation to move the player when the player moves. For example, information regarding a player may be displayed in association with a particular position at a graphically portrayed gaming table on the PTD 24. The user may "drop and drag" this information to the player's new position if the player moves.

In one embodiment, when a player is "moved," the player's rating for present play at a particular gaming table or position is closed and a new rating is automatically opened. Information regarding the player is automatically updated, including information regarding the specific gaming table at which the player is now playing. This avoids the user having to close the player's first session, and manually open a new session including re-entering pertinent player identification and other information.

Of course, a player may be "moved" in other manners. For example, the user may simply enter the player's name, identification number or the like in association with a new game position. The prior rating is then closed and the new one automatically opened and updated.

In one embodiment, the PTD 24 may be operable to displaying location tracking data for a particular player as they move about the game playing area. For example, a player may be tracked via a GPS enabled device carried on their person, such as a cell phone with GPS capabilities or via some other tracking mechanism, such as an RFID or other wireless radio device carried by the player. The location of the person may be displayed graphical representation of the game playing area on a display screen of the PTD 24.

The capability to locate track down a player using the PTD 24 may be useful for providing notification services to the player. For example, a player may be notified when a room is ready, that they have a message, that a dinner reservation is upcoming, a promotion of interest to the player or any other information of importance to the player. The PTD 24 may include a notification interface that allows notification information directed toward a player to be displayed on the PTD 24.

Notification information for a player may be stored in a player's information file on a remote server, such as a player tracking server. When it is determined that a player is in the game playing area, such as when the player initiates a rating session at a table game, then notification messages may be passed along to the player from the user of the PTD 24. At other times, if it is possible to identify that a player is in the game playing area and then locate the player in the game playing area, then it is possible to provide notification services to the player. For example, if the player is located in a bar or restaurant and the player can be tracked to this location, then the player may be provided with a notification message using interfaces generated on the PTD 24.

In one or more embodiments of the invention, the PTD 24 may be used to enroll a player in the player tracking, rewards or other program. Such programs may include slot clubs and table game rewards programs, and general player rewards programs.

In one embodiment, the menu of the player tracking interface 137 may include an "enroll" element. By selecting this element, an enroll function may be initiated. In one embodiment, a graphical user interface is generated and displayed. The graphical user interface data may be generated and/or transmitted from a remote server for display by the PTD 24. The interface may include fields for accepting the input of data, such as player identification information. As is known in the art, a variety of player information is generally obtained for use in enrolling a player in a rewards program, and as such will not be described in detail herein.

Utilizing supplied player information, a remote server may generate one or more files or other data entries corresponding to the player for use in effecting the rewards program for that player. In one embodiment, the player identification information referred to above may be selected or generated by the remote server and transmitted to the PTD 24. The user of the PTD 24 may then utilize this information for a variety of purposes, including starting a session as detailed above.

The user of the PTD 24 may issue the player their player identification information, such as player i.d. number and password. In one embodiment, the user may be permitted to affect the printing of a temporary or permanent player tracking or identification card, such as at a printer 56.

In one embodiment of the invention, groups of players maybe tracked. In casino parlance, specific groups of players are often referred to as "junkets." For example, a tour bus company may bring a group of players from a remote location. The players from this bus tour may be considered as part of a single identifiable junket.

It is desirable for the casino to monitor the activities of the players of a specific junket. For example, the casino may determine that players associated with specific bus tours or tours from specific locations engage in the play of casino games more frequently. The casino may reward these players with complementaries or "comps," as direct advertising to those geographic locations to entice more players and the like. Further, the casino may target comps, such as free game play, to players associated with specific junkets. For example, players may be enticed to take a specific bus tour based upon a casinos offer of $10 of free game credits. When the player reaches the casino, the casino needs to confirm that the player is entitled to the credit and provide the credit.

In accordance with the invention, a user of the PTD 24 may enter or associate a player with a specific group or junket. In one embodiment, a user may input data associating a player with a specific group or junket. For example, a user of the PTD 24 may search within the player tracking system for a list of junkets, select the appropriate junket and then log the player into the junket, such as by inputting their player tracking identification number, player name or the like. As indicated above, a player may not yet be registered with the player tracking system of a casino. The user of the PTD 24 may not only enroll the player, but also associate them with a junket via the PTD 24. In like fashion to the method of enrolling the player, the user may associate a player with a junket by inputting appropriate information.

It will be appreciated that the various functions and features herein need not be associated with the specific menu items or be categorized as indicated above. There may be a greater or lesser number of menu items and the various functions may be presented by other than menu items.

A user of the PTD 24 may initiate a variety of other functions, as evident from the various interfaces 106. Several particular gaming service functions that may be implemented using the gaming operations service interface 135 will now be described in more detail.

The gaming operations service interface 135 may include a number of sub-menu elements. In one embodiment, the gaming operations service interface 135 may be utilized to affect a fill, credit or similar transaction at a gaming table. For example, the user may request a rack fill at a table game. The rack fill may be requested through a central accounting system implemented at a remote server. The rack fill may request that chips be delivered to a particular gaming table. The gaming table may be identified by an identification number or the like. The amount of the rack fill (i.e. chip value) may be verified by the user and transmitted to the accounting system for reconciliation.

Likewise, a user may execute a credit using the PTD 24. For example, if too large a number of chips are retained by the house at a particular table game, the chips may be removed from the casino floor by redemption to the casino cage. The user may request a credit, and when chips are removed, verify such along with the value and the table identification.

It will be appreciated that the fill, credit and similar functions may be implemented in a variety of fashions. For example, the gaming operations service interface 135 may include a fill/credit menu selection. By selecting this menu item, further menu items or a graphical user interface including input data or other fields may be displayed. The user may input data, such as gaming table identification or other information. The information may be transmitted to a remote server for processing.

In one embodiment, the gaming operations service interface 135 may be used to facilitate the "opening" and/or "closing" function associated with a gaming table 21. There are a number of activities associated with a table opening or closing, as is known in the art. One such activity is an accounting activity. At a table closing, the value of the chips, markers and the like are reconciled against the value of the chips, markers and the like associated with the table game at the table opening, less amounts paid out in winnings and plus amounts bet and lost to the house. In this manner assurances are provided that chips or the like are not being stolen, lost or the like.

Similarly, at a table opening, the value of chips, markers or the like is determined for use in the table closing accounting function. Other activities include tracking personnel who are assigned to a table when it opens.

In one embodiment, such activities are implemented using the PTD 24. A user of a PTD 24 may travel to a closing table. There, the user may determine the value of chips, markers and the like and transmit that information to a central accounting system for verification. At the time of table opening, the user may verify the value of chips, markers or the like and transmit such to the accounting system. The user may also identify newly assigned personnel, such as by inputting (such as by card scanning) personnel identification numbers In one embodiment, the gaming operations interface 135 may be used to facilitate the issuance of a marker or its redemption. In one embodiment, the user may utilize the PTD 24 to determine if a player has an available credit balance or to establish a balance. The user may identify a player, such as by name, player tracking identification or the like. A request for credit may be transmitted to a remote server for processing. If credit is available, a marker may be printed. In one embodiment, the marker may be printed at a local printer 56, such as one located near the table game at which the player wishes to play.

As will be appreciated, a wide variety of information may be obtained, input and transmitted in order to process the marker issuance request. Besides player identity, information such as marker amount may be provided. In addition, confirmation of the acceptance of the marker by the player may be provided using the PTD 24. In an embodiment, this acceptance is by endorsement. The endorsement may be by signature. For example, if the marker is approved for printing, a signature block may be generated on the display 102 of the PTD 24. The player may be required to sign in that signature block, such as by using the stylus 103 and input to the display 102.

In other embodiments, the endorsement may be by approval, such as signature, on record. In such an embodiment, confirmation of identity may be required. This confirmation may be provided by biometric identification. For example, a player's fingerprint or retinal scan may be obtained using a peripheral attached to the PTD 24. This information may be transmitted for verification of identity.

As indicated, the PTD 24 may be used to affect marker redemption as well. A particular marker may be identified to the user of the PTD 24. The user may then select the marker within the system, such as by an identification number, by searching for value, player name or the like. Information is then preferably displayed regarding that marker. The user may then select the marker as paid, and this information may be transmitted to the accounting system for update and processing. In another arrangement, the marker may be transferred to a new location for payment, such as to a casino cage. In this embodiment, the user of the PTD 24 may indicate the transfer to reconcile, for example, the change in value at the particular gaming table associated with the transfer of the marker from the table to the casino cage.

In one embodiment, the gaming operations interface 135 may be utilized to obtain game rules and calculate bet payoffs. In one embodiment, the user of the PTD 24 may request game rules. These game rules may be transmitted from a remote location, such as a remote server. A menu or other interface may be provided which enables the user to identify particular game or games for which the rules are sought. In one embodiment, the game rules are transmitted to the PTD 24 as data that is displayed on the display screen 102. In one embodiment, the user may print out the game rules, such as at an adjacent printer 56.

In similar fashion, in one embodiment the user may access a calculating function. The calculating function may be used for a variety of purposes. In one embodiment, the calculating function may be used to determine a bet payoff. This function may be used, for example, to verify the actual payoff based on a player's bet in the event the outcome of the game is winning. The function may also be used to simulate actual payoffs. This function may be used, for example, to verify the payoff at a table game based upon a player's bet.

The calculating function may be associated with the PTD 24 itself. In an embodiment, however, the calculating function is associated with a remote server. In this arrangement, a user may select the calculating function from a menu associated with the gaming operations interface 135. In response to such a selection, the remote server may send graphical user interface information for display by the PTD 24. This interface information may comprise another menu or an interface permitting specific user input, such as field boxes for type of game, amount bet, type of bet and the like. Upon input, the remote server is preferably arranged to execute a function calculating the bet payoff or other function.

In one embodiment, the gaming operations interface 135 may be utilized to initiate a security function. A user may desire to request security for a number of reasons. For example, a player may place an exceptionally large bet at a table game, the user may notice suspicious activity or the like. In any event, the user of the PTD 24 may request a security function. In one embodiment, such a request is transmitted to a remote location, such as a security room. The request may be routed from the PTD 24 via a wireless link via one or more relays to a transceiver associated with a server or network connection to the security room device(s). The request for security may be for a specific type or nature of security, such as personnel intervention, camera monitoring or the like. In addition, the request may include information to aid the security personnel. For example, the request may include a gaming table identification code, location code or the like enabling the security personnel to identify the area or location where the security is desired.

In one embodiment, the gaming operations interface 135 may be used to provide input regarding game data. As indicated above, the game data may be player specific. In another embodiment, the information may be more general. For example, the casino may wish to track the number of players who are playing at a particular gaming table or the number of players or persons within an area of the casino. In such event, the user of the PTD 24 may input such information. The information may be, in one embodiment, player "headcount" information comprising a user count or estimate of the number of players or persons.

Figure 6:
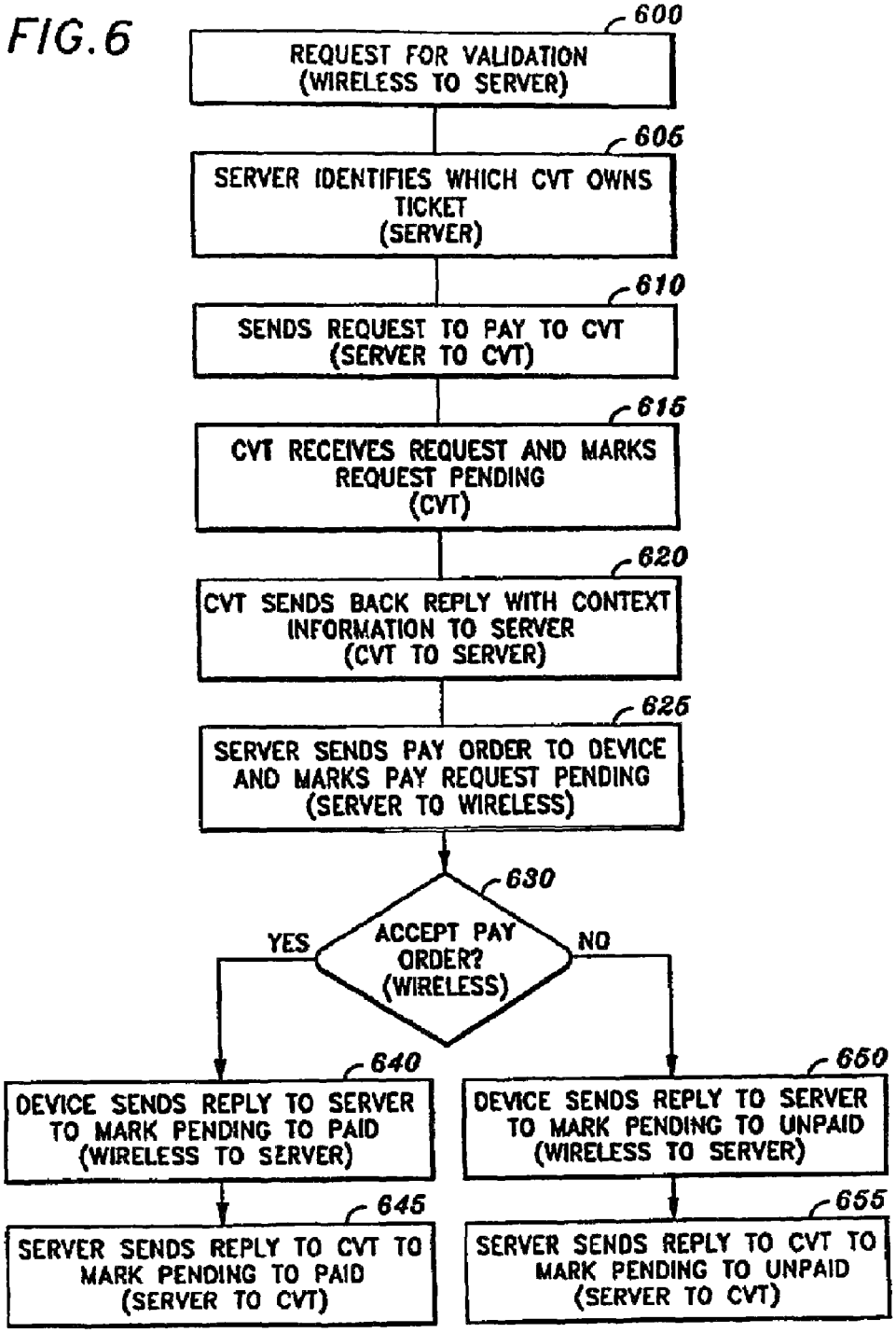
FIG. 6 is a flow diagram of yet another method of use of the portable transaction device of the invention by a gaming service operator.

FIG. 6 is a flow chart depicting another of the functions that may be implemented using the PTD 24, a method for validating information for providing a personal game service. In the embodiment shown in the figure, a ticket is validated in a manner consistent with an EZ Pay ticket system. The EZ Pay ticket is usually used for award tickets. However, the system may be adapted to provide tickets for other services including food services, prize services or accommodation services. At 600, a request for game service transaction information read from a ticket is sent via a wireless communication interface on the PTD 24 to the appropriate transaction server as described with reference to FIG. 1. At 605, the server identifies the appropriate clerk validation ticket (CVT) 34 that "owns" the ticket. When a CVT owns a ticket, the CVT has stored information regarding the status of a particular ticket issued from a gaming machine connected to the CVT 34. At 610, the server sends a request to pay the ticket to the CVT 34 identified as the owner of the ticket. Typically, the pay request indicates that a service on the ticket has been requested. For a cash ticket, a pay request means a request to cash out the ticket has been made. For a free meal, a pay request means a request to obtain the meal has been made. At 615, the CVT 34 receives the pay request for the ticket and marks the ticket pending. While the ticket is pending, any attempts to validate a ticket with similar information is blocked by the CVT 34.

At 620, the CVT 34 sends back a reply with context information to the server. As an example, the context information may be the time and place when the ticket was issued. The information from the CVT 34 to the server may be sent as one or more data packets according to a communication standard shared by the CVT 34 and server. At 625, after receiving the validation reply from the CVT 34, the server marks the pay request pending and sends a pay order to the PTD 24. While the pay request is pending, the server will not allow another ticket with the same information as the ticket with the pay request pending to be validated.

At 630, the game service representative may choose to accept or reject the pay order form the server. When the game service representative accepts the pay order from the server, At 640, the PTD 24 sends a reply to the transaction server confirming that the transaction has been performed. The transaction server marks the request paid which prevents another ticket with identical information from being validated. At 645, the server sends a confirmation to the CVT 34 that allows the CVT 34 to mark the request from pending to paid. When the game service representative rejects the pay order from the server, At 650, the PTD 24 sends a reply to the server to mark the pay request from pending to unpaid. When the ticket is marked unpaid, it may be validated by another PTD 24 or other validation device. At 655, the server sends the reply to the CVT 34 to mark the pay request from pending to unpaid which allows the ticket to be validated As described above, in one or more embodiments of the invention, a ticket may be used to provide credit/value for establishing entitlement to a service or a good, such as the right to play a game or obtain food. As detailed above, the PTD 24 may include a card reader 140. In such an arrangement, a user of the PTD 24 may use a credit card or other magnetic stripe type card for providing credit/value. Alternatively, the PTD 24 may include one or more other types of devices for obtaining/receiving information, such as a smart card reader. In such arrangements, the PTD 24 device may read information from the credit card, smart card or other device. These cards may comprise the well known credit or debit cards. This information may be used to provide the credit/value. In the example of a credit card, the player's account information may be read from the card and transmitted from the PTD 24 to the controller 42. Credit card/credit validation information may be associated with a credit card server (not shown). This credit card server may be associated with a bank or other entity remote from the casino or place of use of the PTD 24 and the controller 42. A communication link may be provided between the controller 42 and remote server for sending credit card information there over.

In one embodiment, when a player utilizes a smart card or credit card the amount of associated credit or value may be transmitted to the EZ Pay server 26, and then the credited amount may be treated in exactly the same manner as if the credit/value had been provided by a ticket. When a player wishes to cash out, the EZ Pay server 26 has a record of the original amount credited and the amounts of any awards, losses or payments, and may then issue the player a ticket representing the user's total credit.

In one or more embodiments, other financial or game related services may be implemented than those specifically described. These services maybe implemented through interfaces 106 that are illustrated, or additional ones. For example, in one embodiment, a user of the PTD 24 may effect the issuance of certain tax transactions, such as the mandatory withholding of taxes and issuance of tax documents to a player upon winning.

It will be appreciated that the system and method of the invention need not be limited to a specific casino or gaming location. For example, the gaming system 20 may have components located at a variety of physically remote locations, such as multiple casinos. This may require, for example, additional communication links, such as implemented by wide or local area networks, and including dedicated or non-dedicated links, including the Internet. In such an arrangement, the gaming system 20 may be used to provide services and track activities of players at multiple locations. For example, in such a configuration, a player may be issued a single player tracking or identification card. The player may utilize that single card at any of the casinos associated with the gaming system 20, and the user of the system may identify the player and provide the services and engage in the functions described above.

In accordance with the invention, a gaming system or environment is provided which includes one or more portable transaction devices. The portable transaction devices permit a user to perform a variety of functions and provide a variety of services to a player. These functions include issuing and validating tickets and other awards, accounting, as well as tracking player game play A means is provided by which a player's play at a table or other game that is not or can not be directly electronically connected to a system, can be tracked. A user of the portable transaction device of the invention may track player play and input the play information for use in a player tracking function of the casino. In addition to the benefit of tracking a player's play for purposes of determining whether the player is entitled to a "comp," the collected information may be used for accounting and other purposes. For example, a casino may aggregate ratings for all players of a specific table game over a period of time. The rating information may be used to verify actual amounts paid or won at the table as indicated by the dealer. This information is useful in identifying if theft is occurring By examining ratings for players at specific table games, including specific table positions, the casino may identify performance and other issues. For example, the casino may identify that a particular table is in an undesirable location, or that the performance of a dealer is sub-par or the like.

Another advantage of the PTD 24 in the gaming environment as detailed is the ability to amass and utilize player identification information. The user of the PTD 24 may verify identification information of a player in person, updating the player's file. The user of the PTD 24 may also utilize remotely stored player identification information in a variety of ways. For example, when the player provides their player tracking card, the PTD 24 may display the player's name and information regarding their game play. The user may then greet the player by name. The user may also converse with the player regarding their play activities, such as "glad to see you are back, we've missed you since your visit last April." In this regard, the user may utilize the information to improve the relationship between the casino and player by making their relationship more personal.

It will be appreciated that the PTDs 24 may be used by a variety of personnel. For example, the PTD 24 user may be assigned to each gaming table. In another embodiment, the PTD 24 may be assigned to a "pit boss" who oversees a group of gaming tables.

Figure 7A:
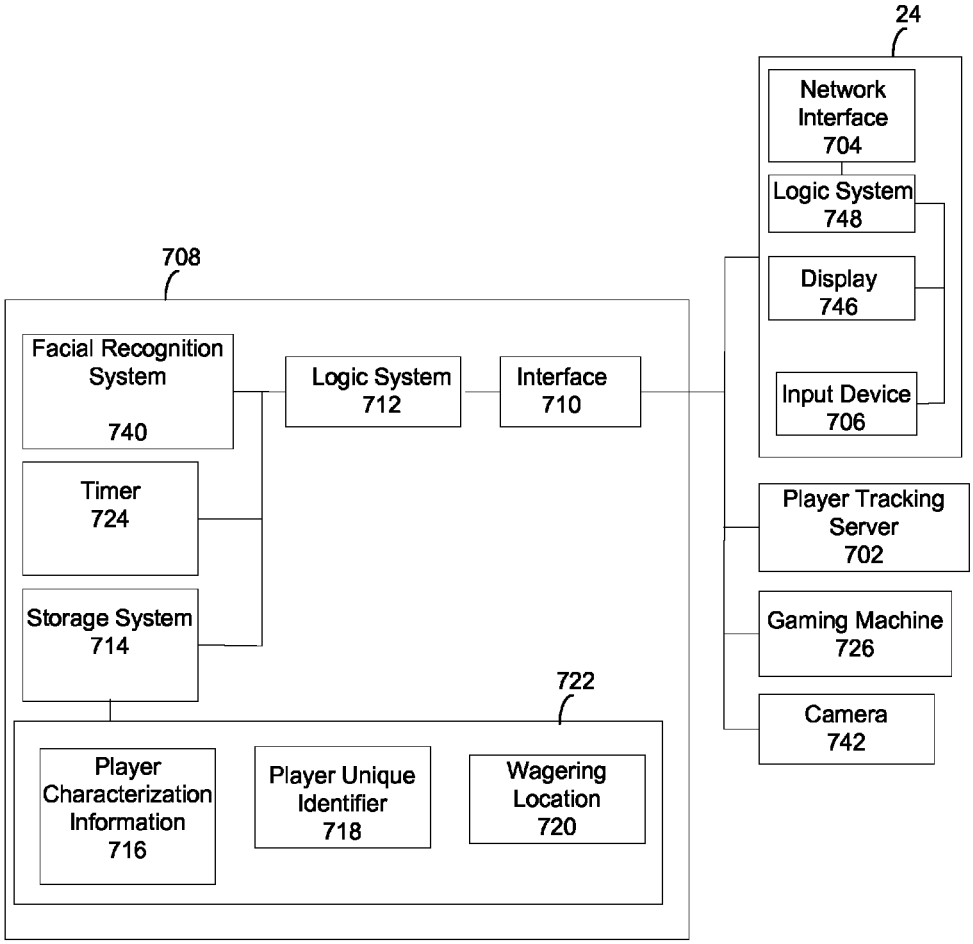
FIGS. 7A and 7B illustrate an example system and method for tracking a game play session.
Figure 7B:
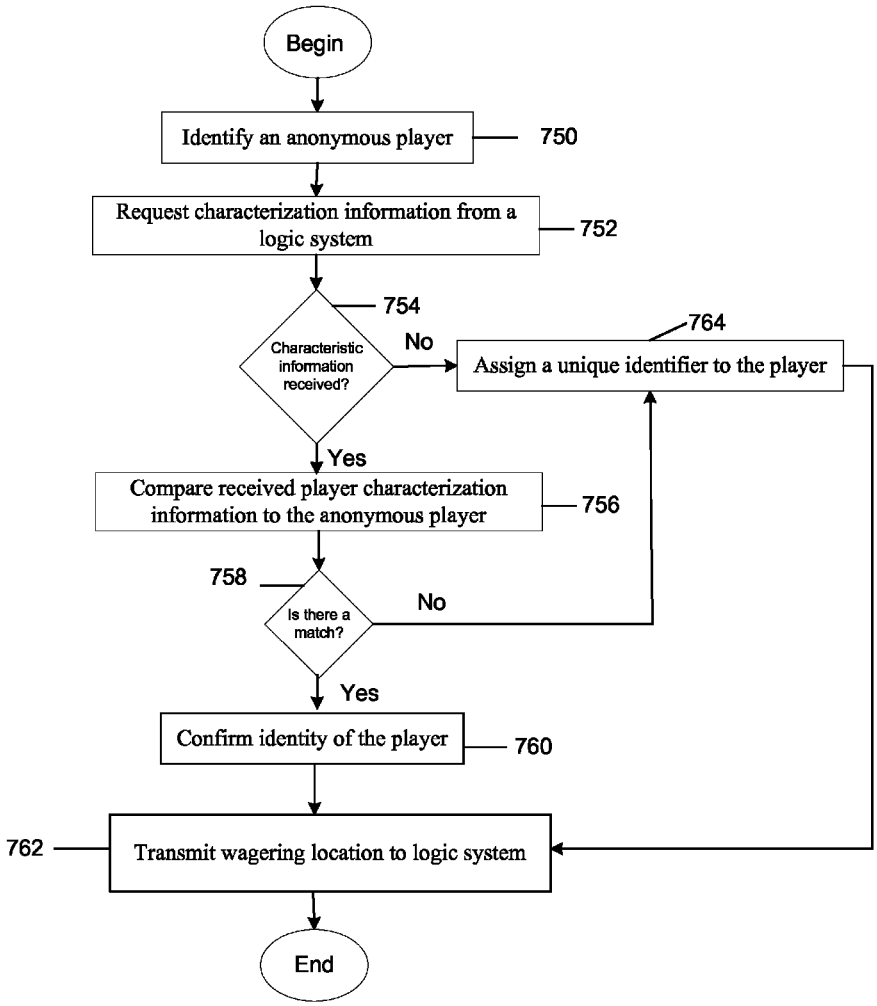

Referring now to FIGS. 7A and 7B, an example system and method for tracking a game play session. Referring to FIG. 7A, PTD 24 may be used to virtually track play sessions of un-carded or anonymous players. An "anonymous" player may be, for example, a player who is not currently using a player loyalty, reward, and/or tracking device such as a player loyalty card, a player loyalty radio frequency identification device, a player loyalty dongle, or other similar devices. In some instances, such a player does not own or does not currently possess a player loyalty, reward, and/or tracking device. The player may or may not be a member of the gaming establishments' reward and/or loyalty program and may or may not be known by the user of the PTD. Even if the player does not wish to join the player loyalty program, some implementations of the invention allows the player's game play session to be tracked with or without the player's knowledge.

A user of the PTD 24 may identify an anonymous player at step 750 of FIG. 7B. The anonymous player may be identified by the user through several means. In one embodiment, the user may be familiar with or recognize the player as a frequent, repeat customer. Alternatively, the user may not know the customer, but may recognize a physical characteristic of the customer. For example, the customer may have an unusual walk, have a flashy tattoo, unique facial hair, blue colored hair, missing limb(s), and the like. Alternatively, the user may notice that the player does not have a player tracking or loyalty card inserted in the gaming machine.

Once the anonymous player is identified, the user may request characterization information to be transmitted from the logic system at step 752 of FIG. 7B to the PTD 24 of FIG. 7A. In one embodiment, if the user is familiar with the player and knows the anonymous player's name, the user may input the user's name into the PTD 24 for transmission to the server 708. Alternatively, the user may only be familiar with the player and may input keywords about the player in the PTD 24 that transmits the keywords to the server 708. For example, if the player has a tattoo of a corvette on her left arm, the user may input "tattoo corvette left arm" as keywords in the PTD 24. In another example, the player may have blue hair and the user may input "blue hair" in the PTD 24.

In another embodiment, the server 708 may receive characteristic information about the player from the gaming machine 726 itself. For example, the server may receive biometric identification of the player from the gaming machine. The player characterization information may be any biometric identification such as facial recognition, fingerprint data, retinal scan data, or the like obtained from any biometric device on the gaming machine. The biometric devices may comprise, e.g., one or more cameras, fingerprint scanners, and the like. The biometric identification may be obtained by a biometric reader coupled to an input button on the gaming machine to read a player's fingerprint. In another example, a retinal scan reader may be coupled to the gaming machine to scan and obtain a player's retinal data. In another example, a camera on the gaming machine may obtain a photograph of the player while the player is playing the game of chance. The biometric information may be transmitted to the logic system 712 to be matched with existing characteristic information stored in the player characterization information database 716 in the storage system 714.

In another embodiment, the user may take a photograph of the player from a camera on the PTD 24. The photograph may then be transmitted to the logic system 712. In yet another embodiment, the server 108 may receive image data from other cameras 742 not on the gaming machine or PTD 24, such as cameras strategically placed throughout the casino. Cameras 742 may include, for example, closed circuit television ("CCTV") cameras, closed circuit digital photography ("CCDP") cameras, range cameras and/or webcams. Accordingly, the images may include still digital images, video feeds, freeze-frames, and the like. Such image data may be used for various purposes, including not only security purposes known in the art but also some implementations of the present invention.

The implementations discussed may involve the use of a facial recognition system 740. The facial recognition system 740 may be one or more computer-driven applications for identifying a person from one or more digital images. Although illustrated as part of server 708, the facial recognition system 740 may be separate and/or remote from server 708. Computing devices to compute the facial recognition data may be desktop computers, workstations, blade servers, mainframe computers, supercomputers or other such devices. The type and number of computing devices may be selected according to the speed and number of calculations and other processes that will be required of them.

As further discussed below, facial recognition system 740 may have facial recognition software used for comparing selected facial features in the live image with stored facial recognition data. Facial recognition algorithms include eigenface, fisherface, the Hidden Markov model, and the neuronal motivated Dynamic Link Matching. An emerging trend uses the visual details of the skin, as captured in standard digital or scanned images. Facial recognition data (some of which may be referred to as a "faceprint" or the like) may be compared to other types of data for more reliable identification. Such data may include fingerprint or eye iris recognition data obtained from the biometric devices on the gaming machine or elsewhere. The biometric devices may gather biometric data unobtrusively, e.g., by including a fingerprint and/or thumbprint reader in one or more control buttons of a gaming machine. According to some implementations of the invention, a tentative patron identification may be evaluated in view of other biometric data, player preference data (e.g., as previously compiled in a player loyalty and/or player tracking database), hotel data, retail data, restaurant/beverage data and/or other data that may be available from other parts of gaming establishment or elsewhere.

Three-dimensional face recognition (3D face recognition) methods involve the three-dimensional geometry of the human face. Some details of recent 3D face recognition methods are described by A. M. Bronstein, M. M. Bronstein and R. Kimmel in "Three-Dimensional Face Recognition" (*Intl. Journal of Computer Vision*, Vol. 64/1, pp. 5-30, August 2005), which is hereby incorporated by reference. It has been shown that 3D face recognition methods can achieve significantly higher accuracy than their 2D counterparts, rivaling fingerprint recognition in accuracy. Some 3D face recognition techniques involve measuring geometry of relatively rigid features of the face. Other methods use a 3D model to improve accuracy of traditional 2D facial recognition techniques by transforming the head into a known view. Some 3D face recognition methods implement depth perception by projecting a grid onto the face and integrating video capture of the face into a high-resolution 3D model. 3D face recognition methods generally require the acquisition of 3D images, which may require a range camera. Accordingly, the data storage and computational requirements for 3D face recognition methods are likely to be greater than those for 2D methods.

The server 708 may have a storage system 714 having a memory storage device 722, such as a random access memory. The memory storage device 722 may store player characterization information 716 received from the PTD 24. However, the memory storage device 722 may store other data such as player unique identifier 718 and wagering location 720. The logic system 712 may comprise one or more logic devices, such as a processor, programmable logic device, or the like. While logic system 712 is depicted as a single system and part of server 708, the functions performed by logic system 712 may be distributed over multiple blades of server 708 and/or multiple devices (such as other servers, host devices, etc.). Although illustrated with one memory storage device 722, storage system 714 may have a plurality of memory storage devices to store information required by the user. A casino computer room or other such central system may include multiple storage devices and/or servers configured to access such storage devices as illustrated with reference to FIG. 9 below. As will now be known, the embodiments discussed may be carried out with various architectural implementations, such as with a server based gaming system as discussed below with reference to FIG. 9.

Once the logic system 712 receives the request for characterization information at step 752 of FIG. 2B, the logic system 712 of FIG. 7A may compare and match the information received from the PTD 24 with player characterization information 716 stored in the storage system 714. Each of the player characterization information 716 may be associated with a corresponding unique identifier 718. In one embodiment, the logic system 712 may receive biometric data from the gaming machine 726 or PTD 24 to match with biometric data stored in the memory storage device 722. For example, the logic system 712 may receive a retinal scan of the player from the gaming machine 726. The logic system may look for the same or similar retinal scans in the player characterization information 716 stored in the storage system 722.

In another embodiment, the logic system 712 may receive a photograph from any or some of the PTD 24, gaming machine 726, or camera 742. The logic system 712 may then use the facial recognition system 740 to match the received photograph with photographs stored in the storage system 714. The logic system 712 may also use multiple characterization information and the facial recognition system 740 to determine the accuracy of the player. For example, the logic system 712 may use the facial recognition with a fingerprint scan to match the player. In another example, the logic system 712 may use the facial recognition with the user's input (e.g. player's playing habit, physical characteristic, and the like to match the player).

In yet another embodiment, the logic system 712 may receive keywords from the PTD 24. The logic system 712 may then match the keywords with the player characterization information 716 stored in the storage system 714. For example, the logic system 712 may search for the keywords "blue hair" in the player characterization information 716.

If there is a match, the player characterization information may be transmitted from the logic system 712 to be received at the PTD 24 via the network interface 710 at step 754 of FIG. 7B. The type of interface 710 of FIG. 7A is not intended to be limiting, as any combination of hardware and software needed to allow the various input/output devices to communicate with the other devices may be used.

The user may compare the characterization information with the player at step 756 of FIG. 7B. However, there may be instances whereby the logic system 712 of FIG. 7A transmits multiple matches or entries to the PTD 24. The multiple entries may result from duplicate entries, non-uniqueness of the player information received, or any other reasons.

In one embodiment, the logic system 712 may transmit multiple matches for the player. For example, there may be several entries that match the keywords "blue hair". In another example, similar photographs found by the logic system 712 may be transmitted to the PTD 24.

The user may then select the appropriate entry that matches the anonymous player if there is a match at step 758 of FIG. 7B. The user may also perform various functions using the PTD 24 of FIG. 7A. For example, the user may reconcile the multiple entries received from the logic system 712. In one embodiment, the user may realize that several photographs received from the logic system 712 are in fact the same player. The user may delete the oldest account and/or import information from the older account to the most recent account of the player.

In another embodiment, the user may perform other functions such as gathering all the data and/or comments stored for the same player. The data may be stored with reference to different player unique identifiers 718 or any other player characterization information 716. The data and/or comments may be information about the player such as the player's various gaming sessions, player's favorite games, player's favorite drink, player's home town, and the like.

The user and/or casino may then virtually track the player by confirming the identity of the player at step 760 of FIG. 7B if there is a match. The user may also transmit the wagering location of the anonymous player to the logic system at step 762. This allows the casino to virtually track the game play of the player without the need for a player tracking card. The user may also transmit any other player characterization information 716 to the logic system 712 such as the player's favorite drink, what games the player prefers to play, and the like. The user may also use the player characterization information to converse with the player regarding their play activities, such as "glad to see you are back, we've missed you since your visit last April." In this regard, the user may utilize the information to improve the relationship between the casino and player by making their relationship more personal.

If the logic system 712 was unable to match the received player characterization information at step 754 of FIG. 7B or the user was unable to match the entries received from the logic system 712 of FIG. 7A at step 758 of FIG. 7B, the player's player session may be tracked in various ways. In one embodiment, the player may be invited to join the casino loyalty program as described above. The user may approach the player and ask whether the player would like to join the casino loyalty program. However, the player may wish to remain anonymous and not be part of the casino loyalty program. Thus, in this embodiment, the user may assign a unique identifier 718 of FIG. 7A to the player at step 764 of FIG. 7B. The unique identifier may be a nickname, a unique player tracking number for the player, or any other means to identify the player. This allows the casino to track the player's game session while allowing the player to remain anonymous.

The user may then transmit the unique identifier 718 of FIG. 7A and the wagering location 720 to the logic system 712 to virtually track the game play of the player at step 762 of FIG. 7B. The player's unique identifier 718 of FIG. 7A may be virtually associated with the wagering location 720 without the need to insert a physical player tracking card. This allows the casino to track the player's game play session without a physical card or revealing the player's identity. In one embodiment, the player's game play session may be tracked without the player's knowledge. The unique identifier may also be assigned to the player without the player's knowledge.

The wagering location may be a gaming machine location, a location at a table game, or any other wagering location. Implementations involving table games may involve other means to track a player's game play session, such as the use of RFID tagged chips as discussed in detail in U.S. patent application Ser. No. 11/224,903, filed on Sep. 12, 2005, entitled "Enhanced Gaming Chips and Table Game Security", which is incorporated herein by reference in its entirety for all purposes. The user of the PTD may virtually track the player by associating the player's unique identifier, RFID tagged chips, and a code assigned to each seat of the table game. The user may then virtually track the game play of the player without a physical player tracking card being presented by the player. The RFID tagged chips may record the player's bets, losses, and wins.

In an alternative embodiment, players at table games may be tracked using the PTD. A two-dimensional representation may, for example, be displayed on display device 746 of PTD 24 and may include a graphical representation of table games, including the gaming table per se and player seating. In one example, the graphically illustrated gaming equipment may be illustrated in the same layout or arrangement as the physical gaming table. The user may associate the player to a particular location from a graphical representation of the gaming environment. The user may also input a table serial number, input the player's identification, and any other information. Display device 746 may be configured to communicate with logic system 748.

In some situations, a player may move from one gaming table to another, or from one position at a gaming table to another position at the same table. As one aspect of the invention, the user of the PTD may "move" a player when the player moves. The user of the PTD may use the graphical representation to move the player when the player moves. For example, information regarding a player may be displayed in association with a particular position at a graphically portrayed gaming table on the PTD. The user may "drop and drag" this information to the player's new position if the player moves.

When a player is "moved," the player's rating for present play at a particular gaming table or position may be closed and a new rating may be automatically opened. Information regarding the player may be automatically updated, including information regarding the specific gaming table at which the player is now playing. This avoids the user having to close the player's first session, and manually open a new session including re-entering pertinent player identification and other information.

Of course, a player may be "moved" in other manners. For example, the user may simply enter the player's unique name, identification number or the like in association with a new game position. The prior rating is then closed and the new one automatically opened and updated.

In one embodiment, the PTD 24 may be operable to displaying location tracking data for a particular player as they move about the game playing area. For example, a player may be tracked via the RFID chips or other wireless radio device carried by the player. The location of the person may be displayed on a graphical representation of the game playing area on a display screen of the PTD.

Player tracking server 702 and/or gaming server 708 may be used to track the player's game play session such that should the player reach a threshold wagering level, the player may receive an award or a comp. The determination may be made based upon the player's level in the players club, amounts bet, or amounts won or lost, or any other criteria, if the player plays one or more gaming devices for a particular length of time or places bets aggregating a certain total. A notification may be transmitted to the PTD 24 to notify the user that the player has reached the threshold game play level and may be rewarded with a comp.

Logic system 712 may have a timer 724 to time the game play session of the player. If after a predetermined period of time, e.g., after ten minutes, there is no activity at the wagering location 720 (e.g. no detection of a wager to play the game of chance, notification from a gaming table dealer, and the like), the unique identifier 718 may be unpaired with the wagering location 720.

Figure 8:
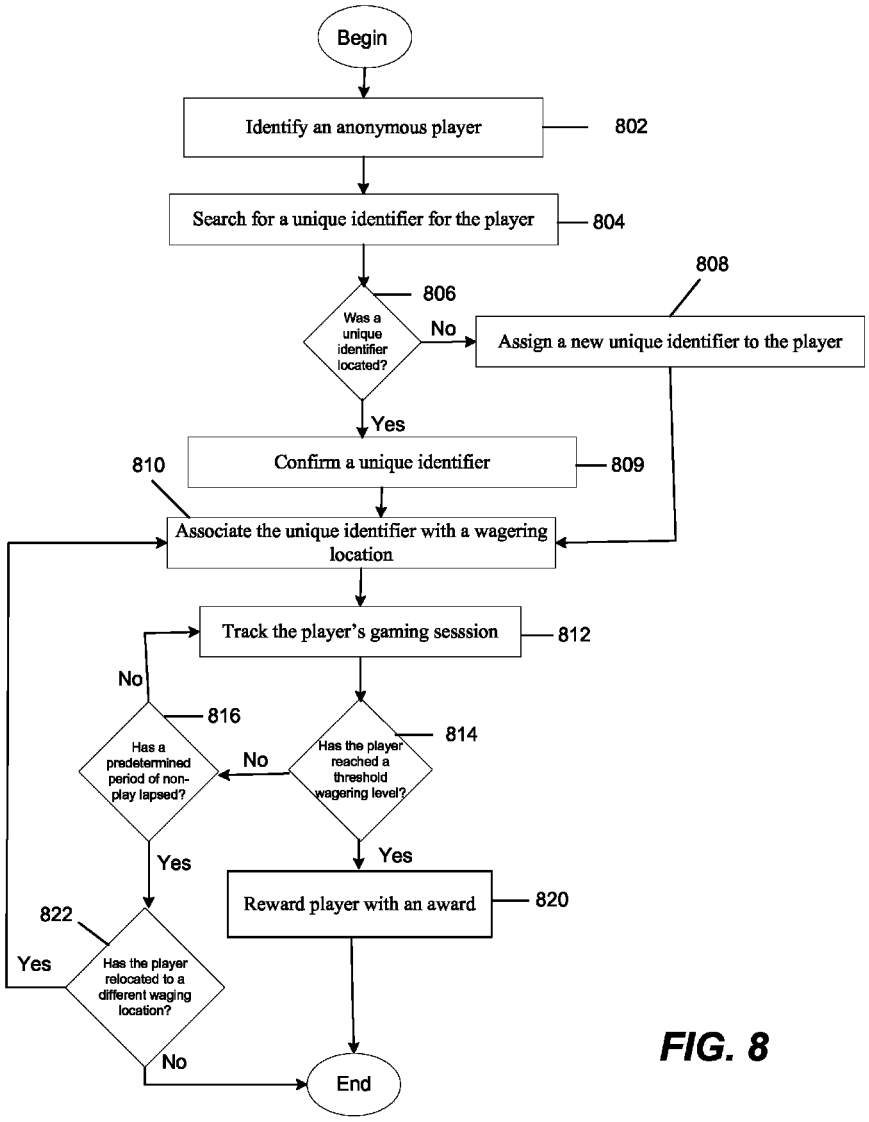
FIG. 8 is a block diagram illustrating an example method for tracking a game play session.

FIG. 8 is a block diagram illustrating an example method for tracking a game play session. A player may be identified as an anonymous player at step 802. Unlike the embodiment described in FIG. 7B, the user may use the PTD to search the storage system for the player at step 804 using the player characterization information or the player unique identifier. In one embodiment, the user may recognize the player as a repeat customer and may have previously assigned a unique identifier to the player.

In another embodiment, the user may simply request a list of unique identifiers from the logic system and scroll through the list. In another example, the user may request a list of pictures with the player's physical or characteristic features. Should the user recognize or is able to match the player at step 806 with a unique identifier, the user may select and confirm that entry at step 809.

If the player's unique identifier is not located at step 806, the player may be invited to join the casino loyalty program. However, should a player want to remain anonymous and/or not join the loyalty program, the player may nonetheless be assigned a unique identifier at step 808.

A virtual card-in may be performed for the player wherein the unique identifier is associated with the wagering location at step 810 without the need or use of a physical player tracking card. The player's game play session may be tracked at step 812. The player's game play session may be tracked such that should the player reach a threshold wagering level at step 814, the player may receive an award or comp. A notification may be transmitted to the PTD to notify the user that the player has reached the threshold game play level and may be rewarded with a comp or reward at step 820.

If the player has not reached a threshold level at step 814, a timer may be used to determine whether game play has occurred over a predetermined period of time at the wagering location, e.g., after ten minutes. If a predetermined period of non-play has occurred at step 816, the unique identifier may be unpaired with the wagering location.

In many situations, the player may have simply relocated to another wagering location at step 822. If so, the process may begin again at step 810 wherein the player's unique identification may be associated with the new wagering location. Once the player's gaming session is over at the original location, the player's points may be automatically associated with the unique identifier, saved and added to future points earned by the player. In another embodiment, the player's points may not be saved and simply purged. In yet another embodiment, the player's points may be associated with the unique identifier and purged after a predetermined period of time, e.g. a few months, years, days, or the like. In still another embodiment, the player may decide to join and become a member of the casino's loyalty program. Thus, any saved points associated with the player's unique identifier, if one was created, may be transferred and associated with the player's new member identification.

The embodiments described herein may be implemented via various network architectures. Such networks may sometimes be referred to herein as server-based gaming networks, Sb™ networks, or the like. Some such gaming networks described herein allow for the convenient provisioning of networked gaming machines and other devices relevant to casino operations. Game themes may be easily and conveniently added or changed, if desired. Related software, including but not limited to player tracking software, peripheral software, etc., may be downloaded to networked gaming machines and other devices, such as kiosks, networked gaming tables, player stations, etc.

The networks may include devices that provide functionality relating to the various embodiments. For example, information may conveniently be collected from networked devices, including but not limited to cameras, RFID readers, gaming machines, etc. Such devices, and other devices, may be controlled by servers, host devices, etc., to further the objects of the invention. For example, a camera may be controlled to zoom in and/or higher-resolution images may be acquired for a particular patron of interest. One or more of servers, host devices, cameras or other devices may be configured with software for patron identification, patron tracking, event detection and/or making responses thereto.

Figure 9:
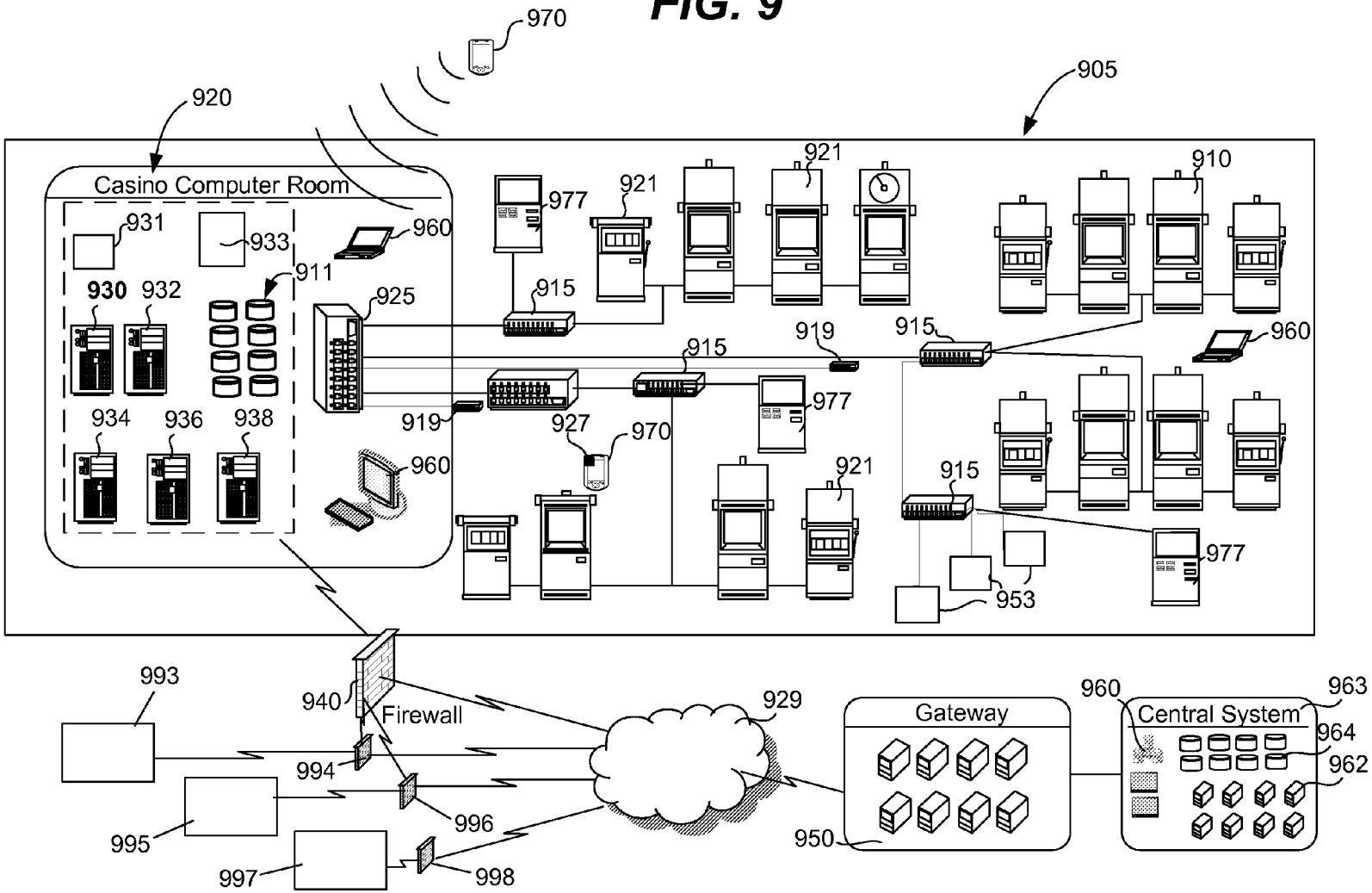
FIG. 9 illustrates an exemplary gaming network that may be used for some implementations of the invention.

One example of an Sb™ network is depicted in FIG. 9. Those of skill in the art will realize that this architecture and the related functionality are merely examples and that the present invention encompasses many other such embodiments and methods. Moreover, other devices that may be used in connection with the present invention do not appear in FIG. 9. For example, a network for implementing the present invention would preferably include a plurality of networked cameras, such as video cameras, smart cameras, digital still cameras, etc., such as those described above with reference to FIGS. 7A and 7B. Moreover, a network for implementing the present invention may also include various RFID readers, RFID switches, middleware servers, and the like.

Here, casino computer room 920 and networked devices of a gaming establishment 905 are illustrated. Gaming establishment 905 is configured for communication with central system 963 via gateway 950. Gaming establishments 993 and 995 are also configured for communication with central system 963.

In some implementations, gaming establishments may be configured for communication with one another. In this example, gaming establishments 993 and 995 are configured for communication with casino computer room 920. Such a configuration may allow devices and/or operators in casino 905 to communicate with and/or control devices in other casinos. In some such implementations, a server in computer room 920 may control devices in casino 905 and devices in other gaming establishments. Conversely, devices and/or operators in another gaming establishment may communicate with and/or control devices in casino 905.

For example, a server of casino 905 or central system 963 may be provisioned with relatively more advanced software (e.g., 3-D facial recognition software) for patron identification than servers of other networked locations. Such a server may process patron identification requests from devices in casino 905 as well as patron identification requests from devices in gaming establishments 993 and 995.

Here, gaming establishment 997 is configured for communication with central system 963, but is not configured for communication with other gaming establishments. Some gaming establishments (not shown) may not be in communication with other gaming establishments or with a central system.

Gaming establishment 905 includes multiple gaming machines 921, each of which is part of a bank 910 of gaming machines 921. In this example, gaming establishment 905 also includes a bank of networked gaming tables 953. However, the present invention may be implemented in gaming establishments having any number of gaming machines, gaming tables, and the like. It will be appreciated that many gaming establishments include hundreds or even thousands of gaming machines 921 and/or gaming tables 953, not all of which are necessarily included in a bank and some of which may not be connected to a network.

Some gaming networks provide features for gaming tables that are similar to those provided for gaming machines, including but not limited to bonusing, player loyalty/player tracking and the use of cashless instruments. Some configurations may provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 953 may be configured for communication with individual player terminals (not shown), which may be configured to accept bets, present an electronic representation of a dealer, indicate game outcomes, etc.

Some gaming networks include electronically configurable tables for playing table games. U.S. patent application Ser. No. 11/517,861, entitled "CASINO DISPLAY METHODS AND DEVICES" and filed on Sep. 7, 2006, describes some such tables and is hereby incorporated by reference. An operator may select a desired game, such as a poker game or a blackjack game, and the table will be automatically configured with geometrical patterns, text, etc., which are appropriate for the desired table game. The desired type of table game may be selected by a control on the table itself or according to instructions received from, e.g., a server or a casino manager via a network interface.

Gaming establishment 905 also includes networked kiosks 977. Depending on the implementation, kiosks 977 may be used for various purposes, including but not limited to cashing out, prize redemption, redeeming points from a player loyalty program, redeeming "cashless" indicia such as bonus tickets, smart cards, etc. In some implementations, kiosks 977 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present invention.

In this example, each bank 910 has a corresponding switch 915, which may be a conventional bank switch in some implementations. Each switch 915 is configured for communication with one or more devices in computer room 920 via main network device 925, which combines switching and routing functionality in this example. Any known communication protocol may be used, such as Gaming Standards Association's G2S Message Protocol, Ethernet-based SuperSAS® protocol, Best of Breed ("BOB"), and the like.

Here, gaming establishment 905 also includes an RFID network, implemented in part by RFID switches 919 and multiple RFID readers (not shown). An RFID network may be used, for example, to track objects (such as mobile gaming devices), patrons, etc., in the vicinity of gaming establishment 905. Some examples of how an RFID network may be used in a gaming establishment are set forth in U.S. patent application Ser. No. 11/655,496, entitled "DYNAMIC CASINO TRACKING AND OPTIMIZATION" and filed on Jan. 19, 2007 and in U.S. patent application Ser. No. 11/599,241, entitled "DOWNLOADING UPON THE OCCURRENCE OF PREDETERMINED EVENTS" and filed on Nov. 13, 2006, both of which are hereby incorporated by reference.

Various alternative network topologies may be used to implement different aspects of the invention and/or to accommodate varying numbers of networked devices. For example, gaming establishments with large numbers of gaming machines 921 may require multiple instances of some network devices (e.g., of main network device 925, which combines switching and routing functionality in this example) and/or the inclusion of other network devices not shown in FIG. 9. Some implementations of the invention may include one or more middleware servers disposed between kiosks 977, RFID switches 919 and/or bank switches 915 and one or more devices in computer room 920 (e.g., a corresponding server). Such middleware servers can provide various useful functions, including but not limited to the filtering and/or aggregation of data received from switches, from individual gaming machines and from other devices. Some implementations of the invention include load-balancing methods and devices for managing network traffic.

Various devices may be disposed within computer room 920 of gaming establishment 905, such as storage devices 911, Sb™ server 930, License Manager 931, Arbiter 933, servers 932, 934, 936 and 938, host device(s) 960, main network device 925, and the like. In practice, more, fewer, or other devices may be used. Depending on the implementation, some such devices may reside in gaming establishment 905 or elsewhere.

One or more devices in central system 963 may also be configured to perform, at least in part, tasks specific to the present invention. For example, one or more servers 962, storage devices 964 and/or host devices 960 of central system 963 may be configured to implement the functions described in detail elsewhere herein. These functions may include, but are not limited to, collecting data from devices (such as cameras, RFID readers, EGMs, cash registers, host devices, mobile devices, etc.), evaluating such data for defined events, determining which patrons may require heightened levels of data gathering and/or service, adding descriptions to audio-visual data associated with such patrons, etc. One or more of the servers of computer room 920 may be configured with software for camera control, patron identification, patron tracking, event detection and/or making responses to detected events.

These servers may be configured for communication with other devices in or outside of gaming establishment 905, such as host devices 960 and mobile devices 970, for implementing some methods described elsewhere herein. Host devices 960 and mobile devices 970, some of which may be associated with computer room 920, may be used to provide the graphical user interfaces and related functionality described above, e.g., with reference to FIG. 3.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the invention provide one or more of these servers in the form of blade servers.

Some preferred embodiments of Sb™ server S30 and the other servers shown in FIG. 9 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the invention, many of these devices (including but not limited to License Manager 931, servers 932, 934, 936 and 938, and main network device 925) are mounted in a single rack with Sb™ server 930. Accordingly, many or all such devices will sometimes be referenced in the aggregate as an "Sb™ server." However, in alternative implementations, one or more of these devices is in communication with Sb™ server 930 and/or other devices of the network but located elsewhere. For example, some of the devices could be mounted in separate racks within computer room 920 or located elsewhere on the network. Moreover, it can be advantageous to store large volumes of data elsewhere via a storage area network ("SAN").

Computer room 920 may include one or more operator consoles or other host devices that are configured for communication with other devices within and outside of computer room 920. Such host devices may be provided with software, hardware and/or firmware for implementing various aspects of the invention. However, such host devices need not be located within computer room 920. Wired host devices 960 (which are desktop and laptop computers in this example) and wireless devices 970 (which are PDAs in this example) may be located elsewhere in gaming establishment 905 or at a remote location.

The communication link(s) between casino 905 and central system 963 preferably have ample bandwidth and may, for example, comprise one or more T1 or T3 connections and/or satellite links having comparable bandwidth, etc. Network 929 is the Internet in this example. However, it will be understood by those of skill in the art that network 929 could include any one of various types of networks, such as the public switched telephone network ("PSTN"), a satellite network, a wireless network, a metro optical transport, etc. Accordingly, a variety of protocols may be used for communication on network 929, such as Internet Protocol ("IP"), Fibre Channel ("FC"), FC over IP ("FCIP"), Internet SCSI ("iSCSI," an IP-based standard for linking data storage devices over a network and transferring data by carrying SCSI commands over IP networks) or Dense Wavelength Division Multiplexing ("DWDM," an optical technology used to increase bandwidth over existing fiber optic backbones).

If a host device is located in a remote location, security methods and devices (such as firewalls 940, 994, 996, 998, authentication and/or encryption) should be deployed in order to prevent the unauthorized access of the gaming network.

Similarly, any other connection between gaming network 905 and the outside world should only be made with trusted devices via a secure link, e.g., via a virtual private network ("VPN") tunnel. For example, the illustrated connection between Sb™ server 930, gateway 950 and central system 963 (that may be used for communications involving peripheral device software downloads, etc.) is advantageously made via a VPN tunnel. Details of VPN methods that may be used with the present invention are described in the reference, "Virtual Private Networks-Technologies and Solutions," by R. Yuan and T. Strayer, Addison-Wesley, 2001, ISBN #0-201-70209-6, which is incorporated herein by reference and for all purposes. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.).

Alternatively, a permanent virtual circuit ("PVC") can be established to provide a dedicated and secure circuit link between two facilities, e.g., between a casino and central system 963. A PVC is a virtual circuit established for repeated use between the same data terminals. A PVC could be provided, for example, via AT&T's Asynchronous Transfer Mode ("ATM") switching fabric. Some implementations provide a dedicated line from an endpoint (e.g., from casino 905) into the ATM backbone. Other implementations provide a connection over another network (e.g., the Internet) between an endpoint and the nearest device of the ATM backbone, e.g., to the nearest edge router. In some such implementations, the fixed-sized cells used in the ATM switching fabric may be encapsulated in variable sized packets (such as Internet Protocol or Ethernet packets) for transmission to and from the ATM backbone.

For security purposes, information transmitted to, on or from a gaming establishment may be encrypted. In one implementation, the information may be symmetrically encrypted using a symmetric encryption key, where the symmetric encryption key is asymmetrically encrypted using a private key. The public key may, for example, be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

Some network implementations may use Trusted Network Connect ("TNC"), which is an open architecture provided by the Trusted Network Connect Sub Group ("TNC-SG") of the Trusted Computing Group (TCG). TNC enables network operators to provide endpoint integrity at every network connection, thus enabling interoperability among multi-vendor network endpoints. Alternatively, or additionally, the Secure Internet File Transfer ("SIFT") may be employed. SIFT allows devices to send and receive data over the Internet in a secure (128-bit encryption) method of transport.

Providing secure connections between devices in a gaming network, such as the connections between the local devices of the gaming network 905 and central system 963, allows for the deployment of many advantageous features. For example, a customer (e.g., an employee of a gaming establishment) may be able to log onto an account of central system 963 to obtain the account information such as the customer's current and prior account status. Automatic updates of a customer's software may also be enabled. For example, central system 963 may notify one or more devices in gaming establishment 905 regarding new products and/or product updates. For example, central system 963 may notify server (or other device) in computer room 920 regarding new software, software updates, the status of current software licenses, etc. Alternatively, such updates could be automatically provided to a server in computer room 920 and downloaded to networked gaming machines.

Providing secure connections between different gaming establishments may enable alternative implementations of the invention. For example, a number of gaming establishments may be owned and/or controlled by the same entity. In such situations, having secure communications between gaming establishments makes it possible for a gaming entity to use one or more servers in a gaming establishment as an interface between central system 963 and gaming machines in multiple gaming establishments. For example, new or updated peripheral device software may be obtained by a server in one gaming establishment and distributed to gaming machines in that gaming establishment and/or other gaming establishments.

Figure 10:
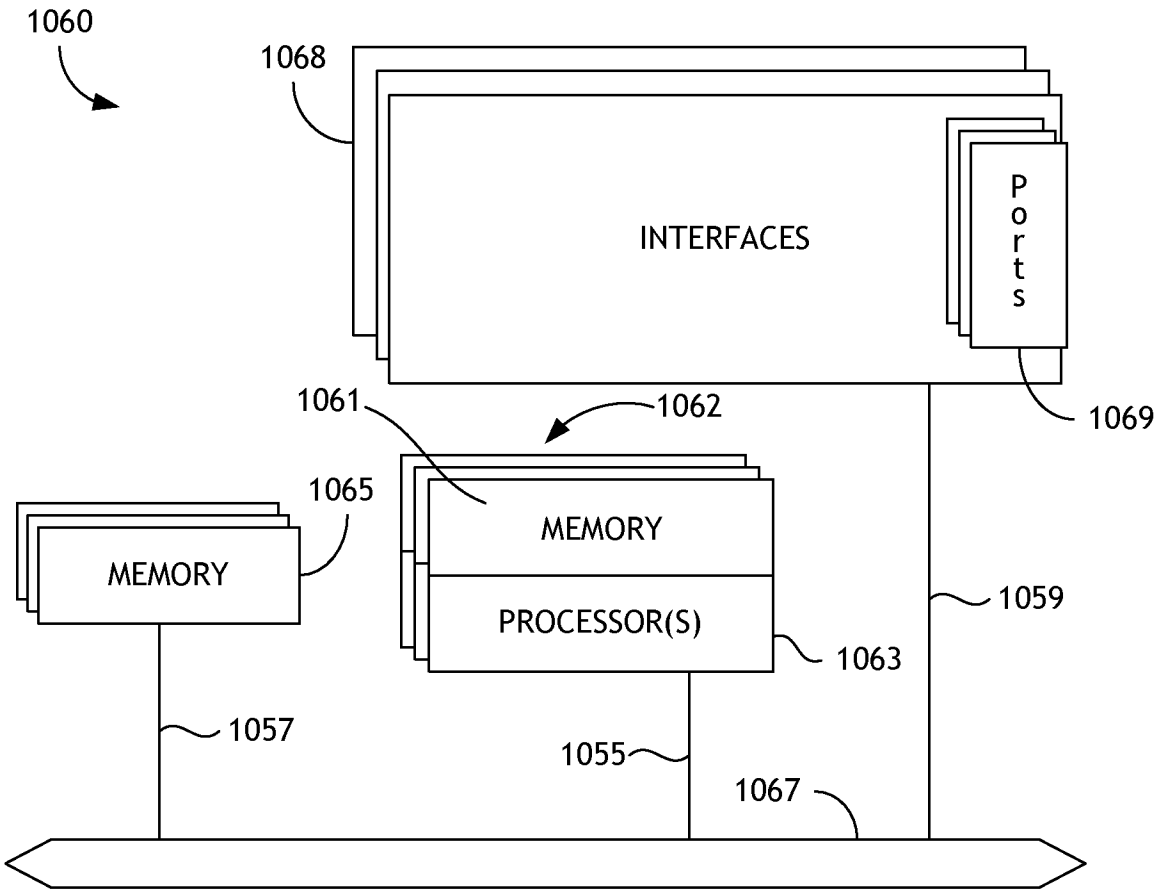
FIG. 10 illustrates a server that may be configured to perform some methods of the invention.

FIG. 10 illustrates an example of a network device that may be configured for implementing some methods of the present invention. Network device 1060 includes a logic system 1062, interface system 1068, and a bus 1067 (e.g., a PCI bus). Generally, interfaces 1068 include ports 1069 appropriate for communication with the appropriate media. In some embodiments, one or more of interfaces 1068 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces of interface system 1068 control such communications-intensive tasks as encryption, decryption, compression, decompression, packetization, media control and management. By providing separate processors for the communications-intensive tasks, interface system 1068 can allow the main logic system 1062 efficiently to perform other functions such as routing computations, network diagnostics, security functions, etc.

The interfaces of interface system 1068 are typically provided as interface cards (sometimes referred to as "linecards"). Generally, interfaces of interface system 1068 control the sending and receiving of data packets over the network and sometimes support other peripherals used with the network device 1060. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention logic system 1062 may be responsible for implementing specific functions associated with the functions of a desired network device. According to some embodiments, logic system 1062 accomplishes all these functions under the control of software including an operating system and any appropriate applications software.

Logic system 1062 may include one or more processors 1063 such as a processor from the Motorola family of microprocessors or the MIPS family of microprocessors. In an alternative embodiment, processor 1063 is specially designed hardware for controlling the operations of network device 1060. In a specific embodiment, a memory 1061 (such as non-volatile RAM and/or ROM) also forms part of logic system 1062. However, there are many different ways in which memory could be coupled to the system. Memory system 1061 may be used for a variety of purposes such as, for example, caching and/or storing data, programming instructions, etc.

Regardless of the network device's configuration, it may employ one or more memories or memory modules (such as, for example, memory system 1065) configured to store data, program instructions for the general-purpose network operations and/or other information relating to the functionality of the techniques described herein. The program instructions may control the operation of an operating system and/or one or more applications, for example. In some implementations, external memory systems may be accessed.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). Examples of program instructions include both machine code, such as produced by a compiler, and files containing higher-level code that may be executed by the computer using an interpreter.

Although the system shown in FIG. 10 illustrates one specific network device of the present invention, it is by no means the only network device architecture on which the present invention can be implemented. For example, an architecture having a single processor that handles communications as well as routing computations, etc. may be used for some implementations. Further, other types of interfaces and media could also be used with the network device. The communication path between interfaces may be bus based (as shown in FIG. 10) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

We claim:

1. A portable transaction device for tracking a gaming session of an anonymous player, comprising:

an input system comprising at least one input device, the input system configured to accept manually entered player characterization data and wagering location data;

an interface system comprising at least one wireless interface configured for communication with a central system;

a display system comprising at least one display device; and a logic system comprising at least one logic device and configured to do the following:

receive anonymous player characterization data and first wagering location data for the anonymous player at a first wagering location, the anonymous player is not signed in to a player loyalty session, wherein the anonymous player characterization data and the first wagering location data were manually entered into the portable transaction device by a casino representative;

transmit, via the interface system, the anonymous player characterization data to the central system;

receive from the central system, via the interface system, matching player characterization data corresponding to multiple matching accounts for the anonymous player based on the anonymous player characterization data;

control the display system to display the multiple matching accounts for the anonymous player;

transmit, via the interface system, a selection of a first matching account of the multiple matching profiles, the first matching account corresponding to the anonymous player;

transmit, via the interface system, the first wagering location data to the central system for association with the first matching account; and transmit, via the interface system, an indication that player data contained in a second matching account should be imported into the first matching account;

wherein the portable transaction device is handheld such that a user can provide the anonymous player characterization data and the first wagering location data for the anonymous player from a game playing area that includes the first wagering location.

2. The portable transaction device of claim 1, wherein the anonymous player characterization data are selected from the group consisting of image data, faceprint data, fingerprint data, retinal scan data and at least one keyword associated with a characteristic of a player.

3. A method for tracking a wager gaming session of an anonymous player, the method comprising:

receiving, at a central system located outside of a game playing area of a casino from a handheld portable transaction device located in the game playing area of the casino over a wireless communication link, anonymous player characterization data and first wagering location data for the anonymous player, the anonymous player is not signed into a player loyalty session at a first wagering location, wherein the first wagering location is located within the game playing area, wherein the handheld portable transaction device is configured to accept manually entered first player characterization data and first wagering location data, and wherein the first player characterization data and the first wagering location data were manually entered into the handheld portable transaction device by a casino representative;

searching, at the central system, stored player characterization data to determine whether the anonymous player characterization data matches stored player characterization data, the stored player characterization data having associated player identifiers;

transmitting, over a wireless communication link, multiple matching accounts for the anonymous player based on the anonymous player characterization data to the handheld portable transaction device according to the result of the searching step;

receiving from the portable transaction device a selection of a first matching account of the multiple matching accounts, the first matching account corresponding to the anonymous player;

receive from the portable transaction device a selection of a second matching account of the multiple matching accounts, the second matching account corresponding to the anonymous player;

associating the first wagering location data and player data within the second matching account with the single matching account; and deleting the second matching account.

4. The method of claim 3, further comprising:

tracking the wager gaming session of the anonymous player at the first wagering location.

5. The method of claim 4, further comprising:

receiving an indication that the anonymous player has moved to a second wagering location, the indication comprising second wagering location data;

associating the first matching account with the second wagering location; and tracking a wager gaming session of the anonymous player at the second wagering location.

6. A method for tracking a wager gaming session, the method comprising:

identifying an anonymous player who is not participating in a player loyalty session at a first wagering location, wherein the first wagering location is within a game playing area of a casino;

transmitting, from a handheld portable transaction device located within the game playing area over a wireless communication link, first player characterization data for the anonymous player and a first wagering location data to a central system, wherein the handheld portable transaction device is configured to accept manually entered first player characterization data and first wagering location data, and wherein the first player characterization data and the first wagering location data were manually entered into the portable transaction device by a casino representative;

receiving, at the handheld portable transaction device over the wireless communication link, a listing of matching player accounts according to a result of a search, the search comprising a search of stored player characterization data to determine whether the first player characterization data matches stored player characterization data, the stored player characterization data having associated player accounts;

transmitting, from the handheld portable transaction device, a selection of a first matching player account from the listing of matching player accounts, the first matching player account corresponding to the anonymous player; and transmitting, from the handheld portable transaction device, a selection of a second matching player account from the listing of matching player accounts, the second matching player account corresponding to the anonymous player, wherein the information associated with the second matching player account is imported into the first matching player account and the second matching player account is subsequently deleted.

7. The method of claim 6, wherein the listing of matching player accounts include at least one player image.

8. The method of claim 6, wherein the first player characterization data are selected from the group consisting of image data, faceprint data, fingerprint data, retinal scan data and at least one keyword associated with a characteristic of the player.

9. The method of claim 6, wherein the player accounts comprise at least one of a nickname and a code.

10. The method of claim 6, further comprising:

determining that the anonymous player has moved to a second wagering location;

transmitting second wagering location data and the first matching player account to a central system; and associating the first matching player account with the second wagering location.

11. A system for tracking a wager gaming session, comprising:

a memory system comprising at least one memory having player characterization data and corresponding player accounts stored thereon, wherein the memory system is located outside of a gaming area of a casino; and a logic system comprising at least one logic device configured to do the following:

receive, from a handheld portable transaction device located in the gaming area, first player characterization data for an anonymous player who is not participating in a player loyalty session at a first wagering location located in the gaming area, wherein the handheld portable transaction device is configured to accept manually entered first player characterization data and first wagering location data, and wherein the first player characterization and the first wagering location data were manually entered into the portable transaction device by a casino representative;

search the stored player characterization data to determine whether the first player characterization data matches stored player characterization data;

transmit multiple matching player accounts to the handheld portable transaction device according to the result of the searching step;

receive a selection of a first matching account of the multiple matching player accounts, the first matching account corresponding to the anonymous player;

receive a selection of a second matching account of the multiple matching player accounts, the second matching account corresponding to the anonymous player;

import player data from the second matching account to the first matching account; and delete the second matching player account.

12. The system of claim 11, wherein the first wagering location comprises a wager gaming machine location or a table game location.

13. The system of claim 11, wherein the logic system is configured to do the following after receiving an indication that the observed player has moved to a second wagering location:

associating the first matching account with the second wagering location; and tracking a wager gaming session of the anonymous player at the second wagering location.

14. The system of claim 13, wherein the second wagering location comprises a wager gaming machine location or a table game location.

* * * * *